US007089858B2

(12) United States Patent
Iwamoto

(10) Patent No.: US 7,089,858 B2
(45) Date of Patent: Aug. 15, 2006

(54) ROTARY PRESS

(75) Inventor: Torao Iwamoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 78 days.

(21) Appl. No.: 10/878,740

(22) Filed: Jun. 29, 2004

(65) Prior Publication Data

US 2005/0028695 A1 Feb. 10, 2005

(30) Foreign Application Priority Data

Aug. 4, 2003 (JP) ..... 2003-285520
Sep. 4, 2003 (JP) ..... 2003-312717

(51) Int. Cl.
*B41F 13/44* (2006.01)
*B41F 3/48* (2006.01)

(52) U.S. Cl. ..... 101/479; 101/480; 101/DIG. 35

(58) Field of Classification Search ..... None
See application file for complete search history.

(56) References Cited

U.S. PATENT DOCUMENTS

| | | | | |
|---|---|---|---|---|
| 4,449,450 | A * | 5/1984 | Barny et al. | 101/232 |
| 5,005,475 | A | 4/1991 | Knauer | 101/218 |
| 5,142,978 | A | 9/1992 | Borel | 101/177 |
| 5,351,616 | A | 10/1994 | Gelinas et al. | 101/218 |
| 5,461,978 | A * | 10/1995 | Chou | 101/248 |
| 5,601,021 | A | 2/1997 | Katabira et al. | 101/218 |
| 5,651,312 | A | 7/1997 | Borghesan | 101/216 |
| 5,802,975 | A | 9/1998 | Prem et al. | 101/375 |
| 5,816,154 | A | 10/1998 | Stuart | 101/216 |
| 5,901,648 | A | 5/1999 | Roland et al. | 101/218 |
| 5,960,714 | A | 10/1999 | Göttling et al. | 101/216 |
| 6,412,409 | B1 * | 7/2002 | Weishew | 101/216 |
| 6,494,138 | B1 | 12/2002 | Göttling et al. | 101/141 |
| 2002/0108520 | A1 * | 8/2002 | Kolbe et al. | 101/479 |

FOREIGN PATENT DOCUMENTS

| | | |
|---|---|---|
| EP | 0737569 A1 | 10/1996 |
| JP | 44-6421 | 3/1969 |
| JP | 48-121 | 1/1973 |
| JP | 58-145728 | 9/1983 |
| JP | 2-258260 | 10/1990 |
| JP | 5-77391 | 3/1993 |
| JP | 6-171059 | 6/1994 |
| JP | 6-297677 | 10/1994 |
| JP | 7-195669 | 8/1995 |
| JP | 8-216365 | 8/1996 |

(Continued)

*Primary Examiner*—Daniel J. Colilla
(74) *Attorney, Agent, or Firm*—Wenderoth, Lind & Ponack, L.L.P.

(57) ABSTRACT

A rotary press is capable of interchanging printing cylinders in a short time with less labor. The rotary press includes a first supporting device for supporting one end of a printing cylinder. The first supporting device is provided in a movable frame arranged outside a first side frame. A second supporting device, for supporting the other end portion of the printing cylinder, is provided in a second side frame. The movable frame is moved in an axial direction of the printing cylinder with respect to the first side frame by a first frame-moving device, whereby the first supporting device is attached on or detached from the one end portion of the printing cylinder. With the first supporting device detached from the one end portion of the printing cylinder by axial movement of the movable frame, the movable frame is further moved with respect to the first side frame by a second frame-moving device.

18 Claims, 21 Drawing Sheets

FOREIGN PATENT DOCUMENTS

| | | | |
|---|---|---|---|
| JP | 9-76453 | | 3/1997 |
| JP | 2715389 | | 11/1997 |
| JP | 10-157057 | | 6/1998 |
| JP | 11-138741 | | 5/1999 |
| JP | 11207922 A | * | 8/1999 |
| JP | 2001-353843 | | 12/2001 |
| JP | 3370144 | | 11/2002 |

* cited by examiner

VIEW TAKEN IN THE DIRECTION OF ARROW B1

VIEW TAKEN IN THE DIRECTION OF ARROW B2

SECTIONAL VIEW TAKEN ALONG LINE E-E

ROTARY PRESS

FIELD OF THE INVENTION

The present invention relates to a rotary press that can change the print length by interchanging printing cylinders.

DESCRIPTION OF THE RELATED ART

FIG. 24 is a schematic diagram showing an example of a rotary press. In this rotary press, a roll of paper (web) is arranged in a paper feed device 1. The web 11 is continuously fed from the paper feed unit 1 into a printing press unit 3, in which the web 1 is printed. In the case where the printing press unit 3 performs multicolor printing, it consists of printing units 7*a* to 7*d*, which correspond to the number of print colors. In FIG. 24, there is shown four-color printing. The printed web 11 passes through a web pass device 5 and is conveyed to a folding machine 6, in which it is cut into sheets of appropriate length. After being folded, the sheets are discharged as a folding book. FIG. 25 shows an example of a typical printing unit 7 (printing units 7*a* to 7*d* in FIG. 24) provided in rotary presses. The printing unit 7 is constructed of an inking device 10 that feeds ink, a damper 12 that supplies dampening water, a plate cylinder 8 with a plate for forming a print image, a blanket cylinder 9 that is a transfer cylinder for transferring the image on the plate cylinder 8 to the web 11, and so forth.

Generally, rotary presses can change the print span by interchanging the web 11 with one differing in width, but cannot change the print length. That is, the print length is determined by the circumference of the plate cylinder 8 or blanket cylinder 9, but typical rotary presses cannot change the diameter of the plate cylinder 8 or blanket cylinder 9. This is one disadvantage of rotary presses, compared with sheet-fed presses that are capable of freely changing the width and length of printing paper.

To overcome the above-described disadvantage, there are techniques disclosed in patent document 1 (Japanese Laid-Open Patent Publication No. HEI 5-77391 corresponding to U.S. Pat. No. 5,142,978) and patent document 2 (Japanese Laid-Open Patent Publication No. HEI 6-171059 corresponding to U.S. Pat. No. 5,351,616). In the techniques disclosed in these two documents, the print length is changed by interchanging printing cylinders (i.e., plate cylinders 8 and blanket cylinders 9) with ones differing in diameter. FIGS. 26 and 27 show printing cylinders disclosed in the patent document 1. The center of rotation of a printing cylinder 9 is accurately held on a fixing shaft 14 arranged inside a supporting shaft 15, and the printing cylinder 9 is fixed at its one end by a fixing device 16. In the case where the diameters of the printing cylinders are changed from ones indicated by solid lines in FIG. 26 (plate cylinder 8, blanket cylinder 9, and press cylinder 19) to ones indicated by broken lines (plate cylinder 8', blanket cylinder 9', and press cylinder 19'), the fixing device 16 is released to retract the fixing shaft 14, as shown in FIG. 27. The printing cylinder 9 can be detached from the supporting shaft 15. The detached printing cylinder 9 is taken out from the front surface of the printing unit by an attaching-detaching device (not shown). And after new printing cylinders have been attached in steps reverse to the detaching steps, arms 17, 20 supporting the new printing cylinders are rotated as shown in FIG. 26, so that the printing cylinders are moved from positions indicated by solid lines to positions indicated by broken lines. In this way, the printing cylinders are held in new positions.

FIGS. 28, 29, and 30 show printing cylinders disclosed in the patent document 2. In the case where the diameters of the printing cylinders are changed from ones indicated by solid lines (plate cylinder 8 and blanket cylinder 9) to ones indicated by broken lines (plate cylinder 8' and blanket cylinder 9'), arms 17, 18 are moved axially to positions indicated by broken lines (positions of arms 17', 18') so as to be detached from the shaft ends of the printing cylinders 8 and 9, as shown in FIG. 29. The detached arms 17, 18 are respectively swung on shafts 23, 24 by arm-moving devices 22 such as that shown in FIG. 30 and are moved to positions detached from the detaching holes 21 in a side frame 13*m*. Or the printing-cylinder supporting arms 17, 18 are further moved in the axial direction and completely detached from the device. In this state, the printing cylinders 8, 9 are detached from the detaching holes 21, and printing cylinders differing in diameter are inserted and attached in steps reverse to the detaching steps. And as shown in FIG. 28, the printing-cylinder supporting arms 17, 18 are rotated so that the new printing cylinders are moved to positions indicated by broken lines, whereby they are held in new positions.

In the technique disclosed in the patent document 1, the entire printing cylinder 9 is interchanged as shown in FIG. 27, so the weight becomes great and the load at the time of cylinder interchange is increased. Also, since the main body of the printing cylinder and the supporting shaft are separate members, the supporting device (printing-cylinder supporting arm) must support the printing cylinder at one end. Because of this, the supporting device requires high rigidity.

On the other hand, in the technique disclosed in the patent document 2, the printing cylinder consists of a shaft and a sleeve fitted on the shaft. Therefore, the printing cylinder can be interchanged by detaching the sleeve from the shaft and interchanging only the sleeve with one differing in diameter. Also, both ends of one shaft are supported by the right and left supporting devices (printing-cylinder supporting arms), so the bending moment applied to each of the supporting devices is small compared with the technique described in the patent document 1 where the main body of the printing cylinder and the supporting shaft are separate members, and the supporting devices can be made smaller.

However, in the technique disclosed in the patent document 2, when interchanging printing cylinders, the arm-moving device has to be detached so that it does not interfere with the printing cylinders that are taken out in the axial direction. The arm-moving device also needs to be detached every time one printing cylinder is interchanged. In the rotary press for multicolor printing shown in FIG. 24, the number of printing units is normally 4 sets or more, so when interchanging to printing cylinders differing in diameter, the arm-moving device must be detached and attached for 32 printing cylinders (i.e., 16 plate cylinders and 16 blanket cylinders). As occasion demands, the detaching and attaching operations for individual supporting arms are also needed to avoid interfere with printing cylinders. Thus, the number of steps to interchange printing cylinders is considerably increased and the interchanging operation is time-consuming, so productivity is reduced.

SUMMARY OF THE INVENTION

The prevent invention has been made in view of the circumstances described above. Accordingly, it is the object of the present invention to provide a rotary press that is capable of interchanging printing cylinders in a short time with less labor.

To achieve this end, there is provided a rotary press that has first and second side frames, a movable frame, a first supporting device, a second supporting device, a first frame-moving device, and a second frame-moving device. The first and second side frames are provided with a space and are used to support a printing cylinder. The movable frame is provided outside the first side frame. The first supporting device is provided in the movable frame and supports one end portion of the printing cylinder. The second supporting device is provided in the second side frame and supports the other end portion of the printing cylinder. The first frame-moving device is used for moving the movable frame in the axial direction of the printing cylinder with respect to the first side frame so that the first supporting device is detachably fitted on the one end portion of the printing cylinder. The second frame-moving device is used for sliding the movable frame with respect to the first side frame, with the first supporting device detached from the one end portion of the printing cylinder by axial movement of the movable frame. Therefore, there is nothing in front of the end portion on the first frame side of the printing cylinder, and there is nothing in front of the side surface of the first side frame, so the printing cylinder can be detached in the axial direction. Thus, according to the rotary press of the present invention, the printing cylinder can be detached by only moving the movable frame in two stages, and the printing cylinder can be interchanged in a short time with less lobar than prior art.

In the rotary press of the present invention, it is preferable that the printing cylinder consist of a shaft and a sleeve. In this case, the printing cylinder is interchanged by detaching only the sleeve from the shaft, with one end of the shaft supported by the second supporting device. By preparing sleeves of the same inside diameter and different outside diameters, the diameter of a printing cylinder can be changed.

In rotary presses, the print length can be changed by changing the diameter of a printing cylinder. In the case of changing the diameter of a printing cylinder, it becomes necessary to adjust the positional relationship between printing cylinders. In the rotary press of the present invention, the first supporting device and the second supporting device are constructed so that positions where the printing cylinder is supported can be adjusted according to the diameter of the printing cylinder. Thus, the print length can be changed.

In rotary presses, a printing press unit is equipped with a plurality of printing cylinders. When interchanging one printing cylinder, as in the case of changing the print length, it is common practice to interchange other printing cylinders at the same time. Therefore, in the case where a printing press unit has a plurality of interchangeable printing cylinders, and the first supporting device and the second supporting device are provided for each of the plurality of interchangeable printing cylinders, the plurality of first supporting devices are provided in the movable frame. In this case, all printing cylinders can be detached and interchanged by movement of one movable frame. Thus, printing cylinders can be interchanged in a short time with less lobar than the case where the first supporting devices for the printing cylinders are provided in separate movable frames. Also, when interchanging a printing cylinder that consists of a shaft and a sleeve, the interchange is performed by detaching only the sleeve from the shaft.

The movable frame and the first side frame are preferably positioned at proper positions, when at least the first supporting device engages with the end portion of the printing cylinder. As the positioning means, one of the movable frame and first side frame is provided with a protruding portion, while the other is provided with a recessed portion. When the first supporting device engages with the end portion of the printing cylinder, the protruding portion is fitted in the recessed portion. The protruding portion and recessed portion can be provided at arbitrary positions. In the case the supporting device has a swingable arm that supports the shaft end of a printing cylinder, the center-of-swing shaft of the supporting arm can be projected to the first side frame side and formed into a protruding portion.

When interchanging a printing cylinder, the first supporting device is detached from the shaft end portion of the printing cylinder and therefore the printing cylinder is supported by only the second supporting device. At this time, there is possibility that the bearing of the second supporting device will undergo great load proportional to the weight of the printing cylinder by the principles of levers. As the countermeasure, the shaft of the printing cylinder further extends outwardly beyond the position where the other shaft end portion is supported by the second supporting device and has a pressure-receiving portion outside the position where the other shaft end portion is supported. The pressure-receiving member is pushed downward by a pressure device. The moment produced by the pushing force offsets the moment produced by the printing cylinder, so the reaction within the bearing becomes smaller and the application of great load to the bearing is prevented. It is preferable that the pressure device be moved between an operating position and a retracted position by a moving device. It is also preferable that a position where the pressure-receiving portion is pushed by the pressure device be finely adjusted at the operating position by adjustment means. The pressure device can be attached to the outside of the second side frame.

Preferably, the pressure device includes a pressure member with a flat pressure surface, and the pressure-receiving portion is rotatably provided on the shaft of the printing cylinder and has an outer peripheral portion constructed of a plurality of flat surfaces. Therefore, the pressure surface can be reliably engaged with the outer periphery of the pressure-receiving portion independently of rotation of the printing cylinder. More preferably, the pressure surface is formed so that a perpendicular line to the pressure surface inclines slightly within a plane perpendicular to the axis of the shaft of the printing cylinder with respect to a direction where the pressure-receiving portion is pushed by the pressure member, and there is provided a stopper near the shaft end portion of the printing cylinder and on a side where the perpendicular line inclines. If the pressure surface inclines, a horizontal component force as well as a vertical component force will occur and the pressure-receiving portion will be displaced in the horizontal direction, but the horizontal displacement of the pressure-receiving portion is regulated by the stopper. This renders it possible to position the pressure-receiving portion accurately in the horizontal direction.

Preferably, the aforementioned first supporting device serves as an arm having one end swingably supported by the movable frame and an intermediate portion that is engaged with one end portion of the printing cylinder. Preferably, the rotary press of the present invention further comprises a position adjustment member having an arm-abutting surface that regulates the position of the arm, constructed so that it is movable back and forth in a direction crossing a direction where the arm swings, and arranged to incline gently with respect to the moving direction so that the arm-abutting surface can continuously and variably adjust the position of the arm by the movement. Preferably, the position adjustment member has a plurality of arm-abutting surfaces on a surface that faces the arm according to a plurality of printing cylinders different in diameter, and also has a connection surface that smoothly connects the plurality of arm-abutting surfaces.

Therefore, when a printing cylinder is interchanged with one differing in diameter, the arm abuts the arm-abutting surface corresponding to the diameter after interchange, whereby the position of the printing cylinder is determined. Further, if the position adjustment member is moved, the fine adjustment of the position of the printing cylinder can be performed. For example, this makes it possible to finely adjust the applied pressure between two printing cylinders that abut each other. Thus, even when a printing cylinder is interchanged with one differing in diameter, fine adjustment can be quickly performed.

Further, the rotary press of the present invention preferably has an arm actuator provided on the other end of the arm for driving the arm in the swing direction. Also, a position where the printing cylinder is supported is adjusted to a predetermined position by performing the movement in the swing direction of the arm by the arm actuator, and by performing fine adjustment of the position of the arm by movement of the position adjustment member.

The fine adjustment of the position of the arm is determined by force applied to the arm-abutting surface by the arm actuator, and a position of the position adjustment member.

The aforementioned arm preferably has a roller follower that abuts the arm-abutting surface of the position adjustment member.

Preferably, the aforementioned printing cylinders are upper and lower printing cylinders provided to abut each other, the aforementioned arm is respectively provided to correspond to the two printing cylinders, and the aforementioned position adjustment member is provided between the two arms and has an upper arm-abutting surface and a lower arm-abutting surface corresponding to the two arms so that positions of the two arms can be simultaneously adjusted.

The aforementioned two printing cylinders are preferably blanket cylinders that transfer images to both sides of a web.

Preferably, the rotary press of the present invention further has a plate cylinders that abuts the blanket cylinder; a plate-cylinder arm having one end swingably supported by the movable frame and an intermediate portion that is engaged with one end portion of the plate cylinder; a plate-cylinder position adjustment member having a plate-cylinder arm-abutting surface that abuts the plate-cylinder arm to regulate the position of the plate-cylinder arm, and constructed so that it can move back and forth in the same direction as the swing direction of the plate-cylinder arm; and a plate-cylinder actuator provided on the other end of the plate-cylinder arm for driving the plate-cylinder arm in the swing direction. Preferably, a position where the plate cylinder is supported is adjusted to a predetermined position by performing the movement in the swing direction of the plate-cylinder arm by the plate-cylinder actuator, and by performing fine adjustment of the position of the plate-cylinder arm by movement of the plate-cylinder position adjustment member.

In this case, the plate-cylinder arm preferably has a roller follower that abuts the plate-cylinder arm-abutting surface of the plate-cylinder position adjustment member.

BRIEF DESCRIPTION OF THE DRAWINGS

The present invention will be described in further detail with reference to the accompanying drawings wherein.

DESCRIPTION OF THE PREFERRED EMBODIMENTS

Figure 1:
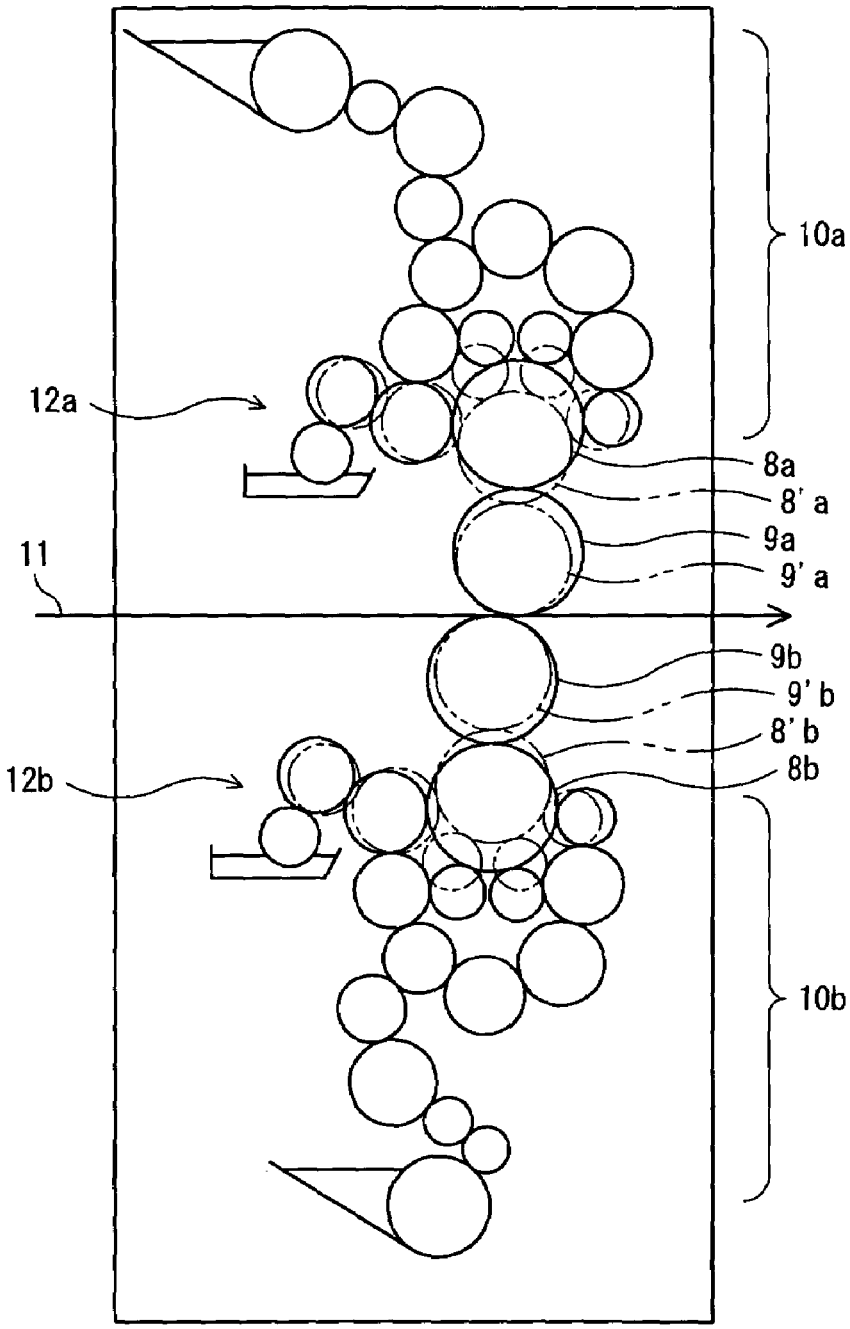
FIG. 1 is a schematic diagram showing a printing unit constructed in accordance with a first embodiment of the present invention.

Embodiments of the present invention will hereinafter be described with reference to the drawings.

(A) First Embodiment

Referring to FIGS. 1 through 12, there is shown a printing unit constructed in accordance with a first embodiment of the present invention. The parts or members corresponding to those described above (which do not always mean having the same structure) are represented by the same reference numerals.

As shown in FIG. 1, the printing unit of a rotary press in this embodiment is constructed as a perfecting press that prints on both sides of a web 11 at once. For that reason, the printing unit is equipped with an inking device 10*a* and damper 12*a* above the web 11 and an inking device 10*b* and damper 12*b* below the web 11. The inking devices 10*a*, 10*b* are equipped with plate cylinders 8*a*, 8*b* and blanket cylinders 9*a*, 9*b*, respectively. In the rotary press of this embodiment, the plate cylinders 8 and blanket cylinders 9 (there are cases where the plate cylinder and blanket cylinder are referred to as printing cylinders) can be interchanged with ones differing in diameter, as indicated by solid lines and broken lines in FIG. 1. In each figure including FIG. 1, "a" and "b" added after reference numerals are intended to refer to members arranged above and below the web 11, respectively. In the following description, when discriminating between upper and lower members, "a" and "b" are added. When not discriminating between upper and lower members, they are represented by only reference numerals. Also, in each figure including FIG. 1, "'" and "'" added after reference numerals are intended to mean the state in which the shape or position of a member of the same reference numeral without "'" and "'" has been changed.

Figure 2:
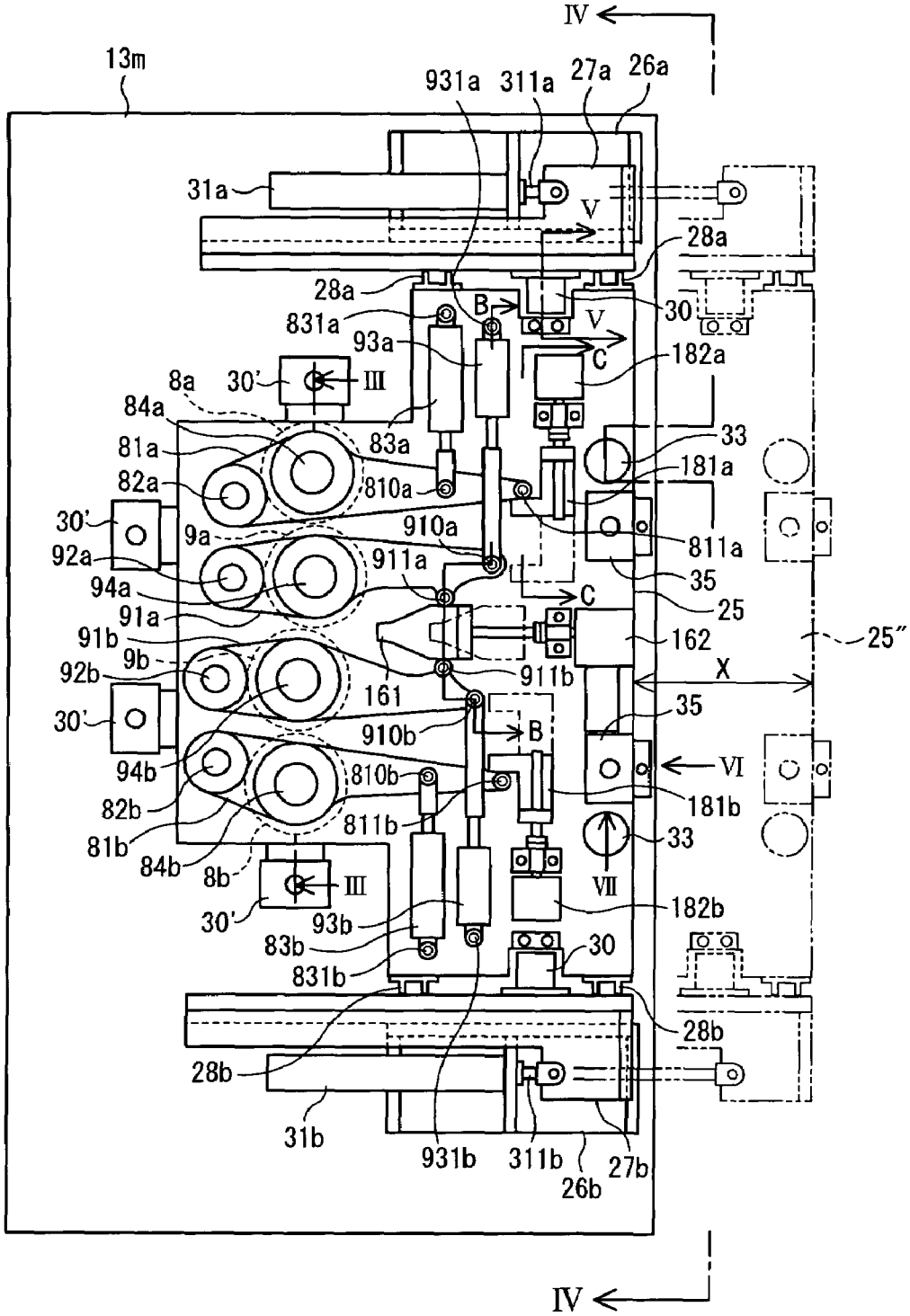
FIG. 2 is a side view showing the printing unit.
Figure 3:
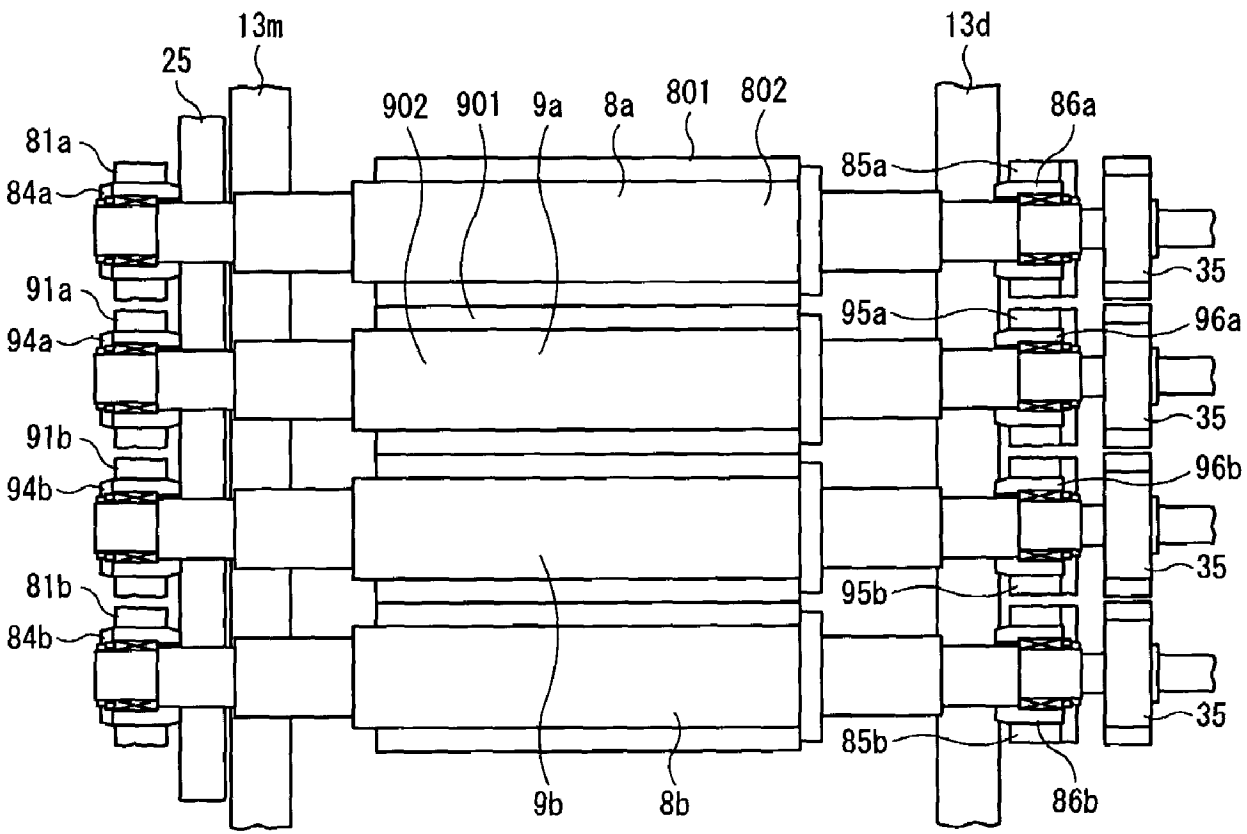
FIG. 3 is a sectional view taken along line III—III of FIG. 2.

FIG. 2 shows a side view of the printing unit shown in FIG. 1, FIG. 3 shows a sectional view taken along line III—III of FIG. 2, and FIG. 4 shows a sectional view taken along line IV—IV of FIG. 2. As shown in FIG. 3, the printing unit is provided with a pair of spaced side frames 13*m* and 13*d*, between which the printing cylinders 8, 9 are arranged. Also, a movable frame 25 is arranged outside the first side frame 13*m*. The side frames 13*m*, 13*d* are stationary, whereas the movable frame 25 can be moved by frame-moving means to be described later. The printing cylinders 8, 9 consist of shafts 802, 809 and sleeves 801, 901 fitted on the shafts 802, 809. The right ends of the printing-cylinder shafts 802, 809 are supported through bearings 86, 98 by printing-cylinder supporting arms (second supporting devices) 85, 95 attached to the second side frame 13*d*, while the left ends of the printing-cylinder shafts 802, 809 are supported through bearings 84, 94 by printing-cylinder supporting arms (first supporting devices) 81, 91 attached to the movable frame 25.

The printing-cylinder supporting arms 81, 91 on the left side of the movable frame 25 support the bearings 84, 94 of the printing cylinders 8, 9 at the central portions, as shown in FIG. 2. The left ends of the printing-cylinder supporting arms 81, 91 extending from the central portions are swingably fitted on shafts 82, 92 provided in the movable frame 25, while the right ends are coupled with the rods of supporting-arm actuators 83, 93 through arm-supporting pins 810, 910. The supporting-arm actuators 83, 93 are rotatably attached to the movable frame 25 through actuator-supporting pins 831, 931. The supporting-arm actuators 83, 93 can utilize compressed air pressure, hydraulic pressure, and an electric motor, but the supporting-arm actuators 83, 93 shown in FIG. 2 are constructed of hydraulic cylinders utilizing hydraulic pressure. If the supporting-arm actuators 83, 93 are operated, the printing-cylinder supporting arms 81, 91 are swung on the shafts 82, 92, whereby the position of each of the bearings 84, 94 (i.e., the center position of each of the printing cylinders 8, 9) can be changed. The description of the structure of the printing-cylinder supporting arms 85, 95 on the right side of the second side frame 13*d* will not be given, but they may have the same structure as the above-described printing-cylinder supporting arms 81, 91 provided on the left side of the movable frame 25. Or they may be constructed to follow the swing of the printing-cylinder supporting arms 81, 91 without providing actuators.

Also, the right end portion of the printing-cylinder supporting arm 91*a*, coupled with the pin 910*a* and facing the printing-cylinder supporting arm 91*b*, has a roller follower 911*a*. Similarly, the right end portion of the printing-cylinder supporting arm 91*b*, coupled with the pin 910*b* and facing the printing-cylinder supporting arm 91*a*, has a roller follower 911*b*. And the roller followers 911*a*, 911*b* of the printing-cylinder supporting arms 91*a*, 91*b* abut the position adjustment member 161 of an applied-pressure adjuster 160 described later, whereby the positions in the swing direction of the printing-cylinder supporting arms 91*a*, 91*b* (i.e., the positions of the bearings 84, 94 of the blanket cylinders 9*a*, 9*b* (i.e., the center positions (supported positions) of the printing cylinders 8, 9) are regulated.

Figure 4A:
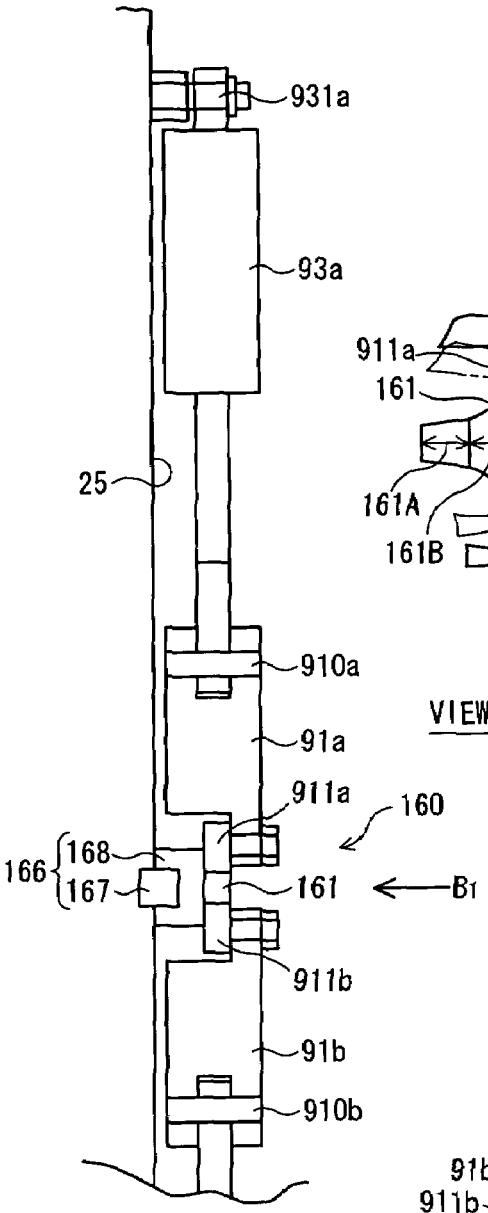
FIG. 4A is a sectional view taken along line B–B of FIG. 2.
Figure 4B:
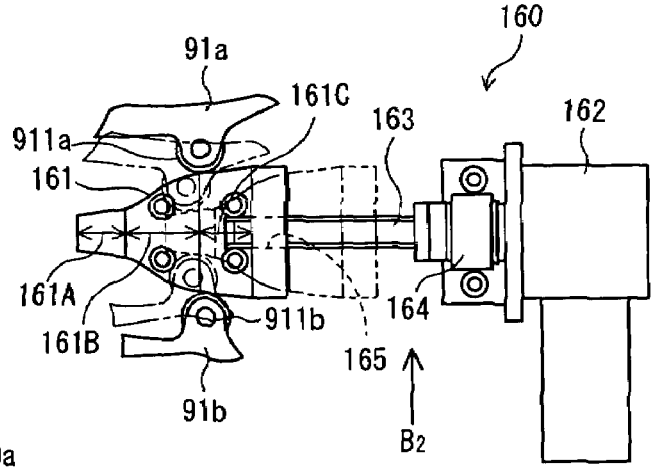
FIG. 4B is a view taken in the direction of arrow $B_1$ of FIG. 4A.
Figure 4C:
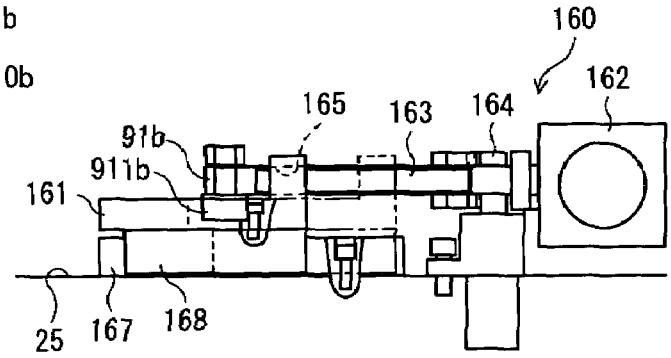
FIG. 4C is a view taken in the direction of arrow $B_2$ of FIG. 4B.

As shown in FIGS. 4A to 4C, the applied-pressure adjuster 160 is constructed mainly of a direct-acting bearing 166 provided in the movable frame 25, and an adjustment-member actuator 162 that causes the position adjustment member 161 to move along the direct-acting bearing 166. The direct-acting bearing 166 is constructed of a rail 167 fixedly provided in a direction perpendicular to the direction where the printing-cylinder supporting arms 91*a*, 91*b* swing, and a bed 168 movably supported on the rail 167. The position adjustment member 161 is fixed on the movable bed 168.

The adjustment-member actuator 162 also rotates a movable screw 163 provided in parallel with the rail 167, and the adjustment-member actuator 162 and movable screw 163 are supported to the movable frame 25 through an actuator-supporting shaft 164. The movable screw 163 meshes with a female screw 165 formed in the position adjustment member 161. Thus, if the movable screw 163 is rotated by the adjustment-member actuator 162, the position adjustment member 161 is caused to move back and forth at low speeds along the rail 167.

As shown in FIG. 4B, the position adjustment member 161 of this embodiment is characterized by its shape. More specifically, the position adjustment member 161 has arm-abutting surfaces 161A and 161C that are abutted by the roller followers 911*a*, 911*b* of the printing-cylinder supporting arms 91*a*, 91*b*, and a connection surface 161B that smoothly connects the arm-abutting surfaces 161A, 161C together. Also, the position adjustment member 161 may have a plurality of arm-abutting surfaces 161A, 161C that correspond to printing cylinders of different diameters. In this embodiment, the position adjustment member 161 is formed so it can adjust positions of two blanket cylinders 9*a* of different diameters and positions of two blanket cylinders 9*b* of different diameters. That is, the position adjustment member 161 has two arm-abutting surfaces 161A, 161C at the top surface (which faces the printing-cylinder supporting arm 91*a* of the blanket cylinder 9*a*) to correspond to two blanket cylinders 9*a* of different diameters. The position adjustment member 161 further has two arm-abutting surfaces 161A, 161C at the bottom surface (which faces the printing-cylinder supporting arm 91*b* of the blanket cylinder 9*b*) to correspond to two blanket cylinders 9*b* of different diameters.

Also, the arm-abutting surface 161A corresponds to blanket cylinders 9*a*, 9*b* smaller in diameter, while the arm-abutting surface 161C corresponds to blanket cylinders 9*a*, 9*b* greater in diameter.

Note that the position adjustment member 161 and printing-cylinder supporting arms 91*a*, 91*b*, indicated by two-dot chain lines in FIG. 4B, are arranged so as to correspond to blanket cylinders 9*a*, 9*b* smaller in diameter. On the other hand, the position adjustment member 161 and printing-cylinder supporting arms 91*a*, 91*b*, indicated by solid lines, are arranged so as to correspond to blanket cylinders 9*a*, 9*b* greater in diameter.

Furthermore, the arm-abutting surfaces 161A, 161C incline gently in the direction where the position adjustment member 161 moves back and forth. Thus, the regulated positions in the swing direction of the printing-cylinder supporting arms 91*a*, 91*b* can be continuously adjusted by the movement of the position adjustment member 161. Also, the arm-abutting surfaces 161A, 161C of the position adjustment member 161 are smoothly connected by the connection surface 161B.

In this embodiment, the top surface side and bottom surface side of the position adjustment member 161 are provided with two arm-abutting surfaces 161A, 161C and one connection surface 161B to handle two blanket cylinders 9*a* of different diameters and two blanket cylinders 9*b* of different diameters. In the case of handling n blanket cylinders 9*a* of different diameters and n blanket cylinders 9*b* of different diameters, the position adjustment member 161 needs to have n arm-abutting surfaces and (n−1) connection surfaces on the top surface side and bottom surface side, respectively.

As shown in FIG. 2, the right end of the printing-cylinder supporting arm 81*a* that is coupled with the arm supporting pin 810*a* has a roller follower 811*a*. Likewise, the right end of the printing-cylinder supporting arm 81*b* that is coupled with the arm supporting pin 810*b* has a roller follower 811*b*. And the roller followers 811*a*, 811*b* of the printing-cylinder supporting arms 81*a*, 81*b* abut the plate-cylinder position adjustment members 181*a*, 181*b* of applied-pressure adjusters 180*a*, 180*b* described later, whereby the positions in the swing direction of the printing-cylinder supporting arms 81*a*, 81*b*, that is, the positions of the bearings 84, 94 of the plate cylinders 8*a*, 8*b*, that is, the center positions (supported positions) of the printing cylinders 8, 9 are regulated.

Figure 5B:
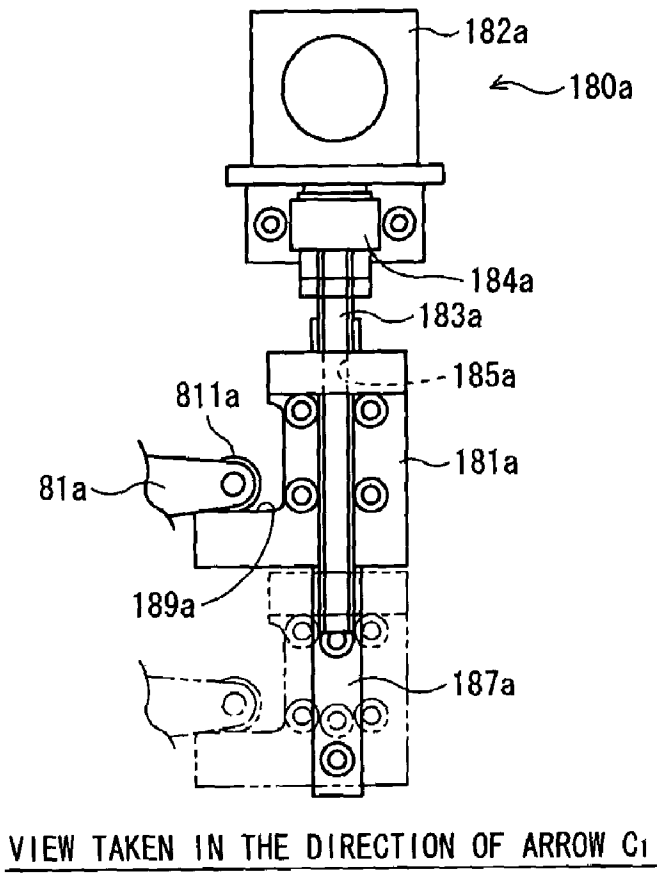
FIG. 5B is a view taken in the direction of arrow $C_1$ of FIG. 5A.
Figure 5A:
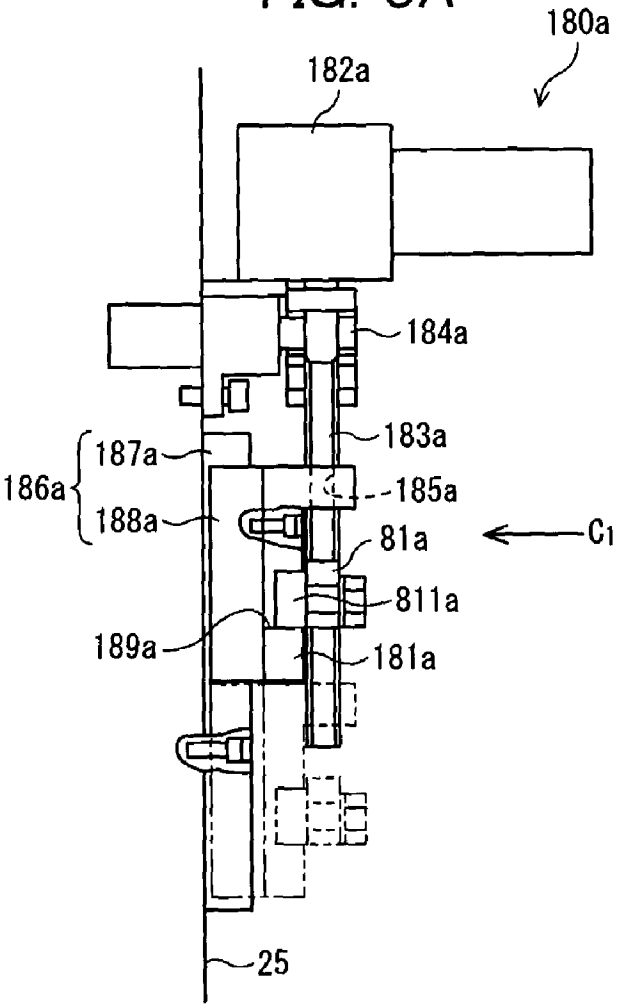
FIG. 5A is a sectional view taken along line C—C of FIG. 2.

The applied-pressure adjuster 180*a* will be described in further detail with reference to FIGS. 5A and 5B. The applied-pressure adjuster 180*a* is constructed mainly of a direct-acting bearing 186*a* provided on the movable frame 25, and a second adjustment-member actuator 182*a* that causes the plate-cylinder position adjustment member 181*a* to move along the direct-acting bearing 186*a*. The direct-acting bearing 186*a* is constructed of a rail 187*a* fixedly provided in a direction perpendicular to the direction where the printing-cylinder supporting arm 81*a* swings, and a bed 188*a* movably supported on the rail 187*a*. The plate-cylinder position adjustment member 181*a* is fixed on the movable bed 188*a*.

The second adjustment-member actuator 182*a* also rotates a movable screw 183*a* provided in parallel with the rail 187*a*, and the second adjustment-member actuator 182*a* and movable screw 183*a* are supported to the movable frame 25 through an actuator-supporting shaft 184*a*. The movable screw 183*a* meshes with a female screw 185*a* formed in the plate-cylinder position adjustment member 181*a*. Thus, if the movable screw 183*a* is rotated by the second adjustment-member actuator 182*a*, the plate-cylinder position adjustment member 181*a* is able to move vertically at low speeds along the rail 187*a*.

The plate-cylinder position adjustment member 181*a* also has an abutting portion 189*a*, which abuts the roller 811*a* of the printing-cylinder supporting arm 81*a*. If the abutting portion 189*a* abuts the roller 811*a*, the position in the swing direction of the printing-cylinder supporting arm 81*a* is regulated. After the printing-cylinder supporting arm 81*a* has been positioned, the position in the swing direction of the printing-cylinder supporting arm 81*a* can be finely adjusted by vertically moving the plate-cylinder position adjustment member 181*a* by the second adjustment-member actuator 182*a*.

While the applied-pressure adjuster 180*a* has been described, an applied-pressure adjuster 180*b* has the same structure as the applied-pressure adjuster 180*a*. In FIGS. 5A and 5B, the second adjustment-member actuator 182*a* consists of a motor and a speed reducer, but it is not limited to them.

Figure 6:
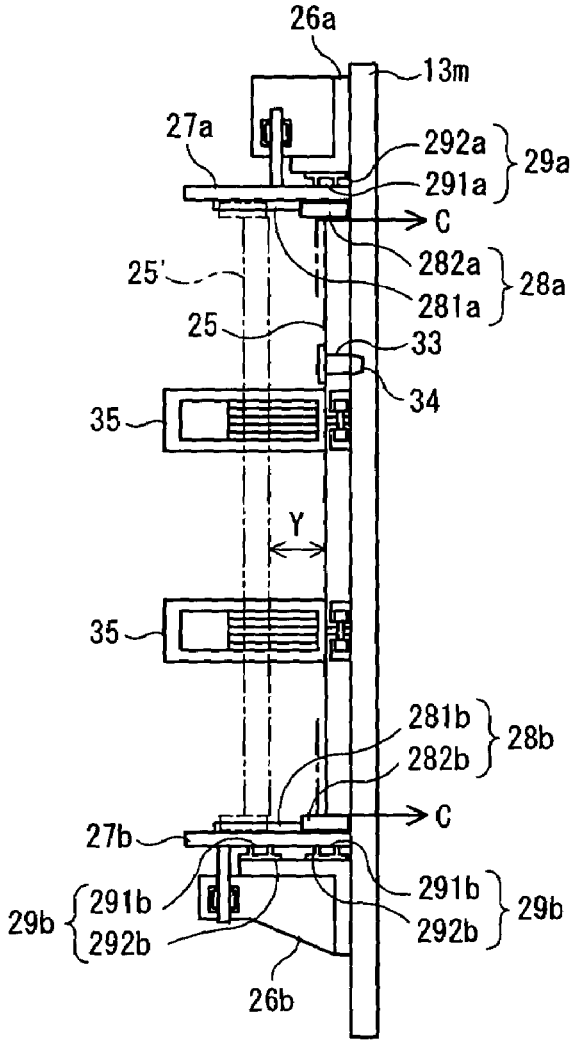
FIG. 6 is a part-sectional view taken along line IV—IV of FIG. 2.

Now, a description will be given of frame-moving means that causes the movable frame 25 to move. As shown in FIGS. 2 and 6, the movable frame 25 is attached to the manipulation-side side frame 13*m* through a stationary bracket 26 and a lateral movement bracket 27. The stationary bracket 26 is fixed to the side frame 13*m*, and the lateral movement bracket 27 is fixed in the direction of the printing-cylinder shaft (Y direction in FIG. 6) and is movably supported in the lateral direction (X direction in FIG. 2) by the stationary bracket 26 through a direct-acting bearing 29 for lateral movement. The direct-acting bearing 29 consists of a rail 291 and a bed 292. The bed 292 is fixed on the stationary bracket 26, and the rail 291 is fixed on the movable bracket 27. Thus, the lateral movement bracket 27 holding the movable frame 25 is able to move laterally with a high degree of accuracy.

Figure 10:
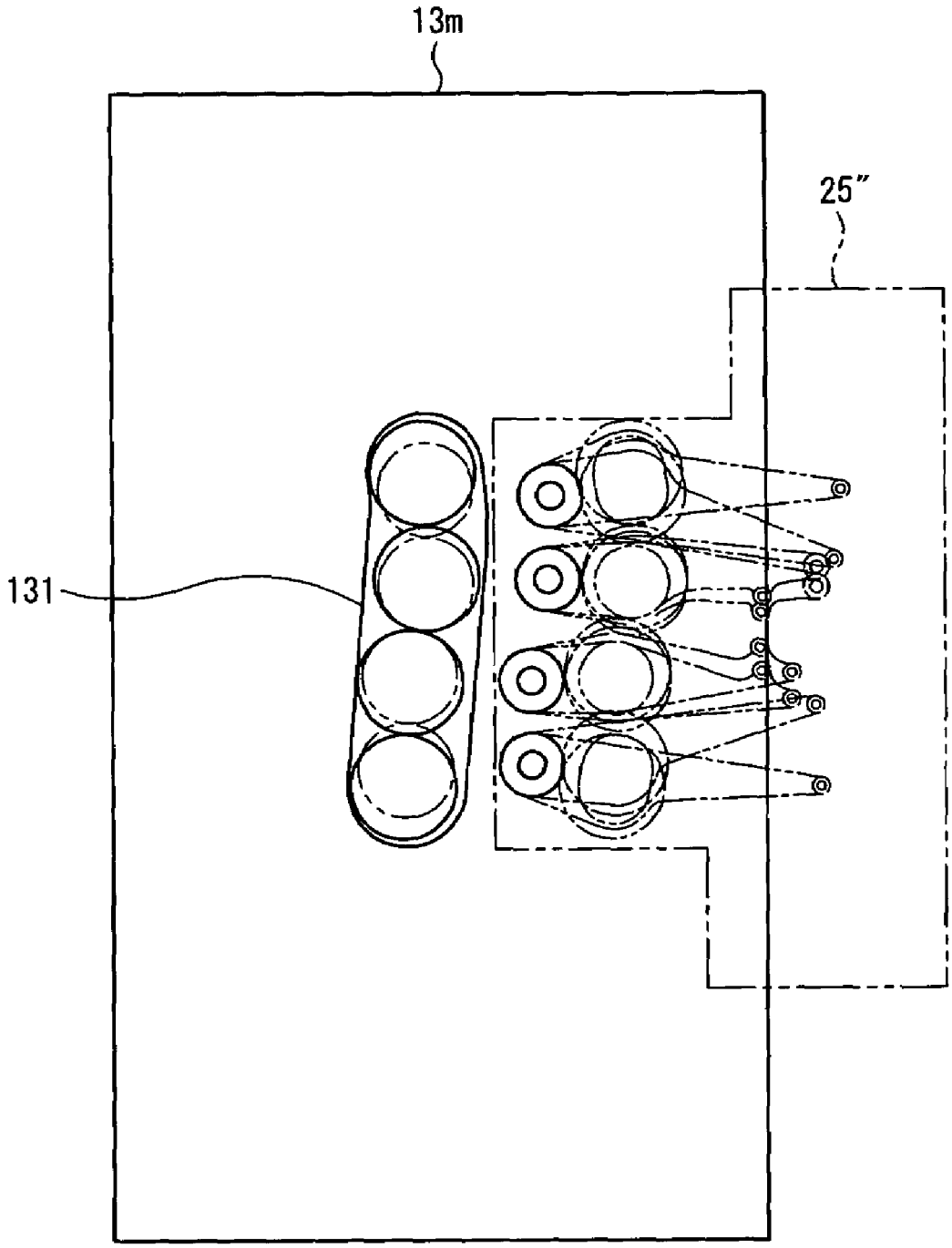
FIG. 10 is a diagram showing the state in which a movable frame in FIG. 2 is slid.
Figure 11:
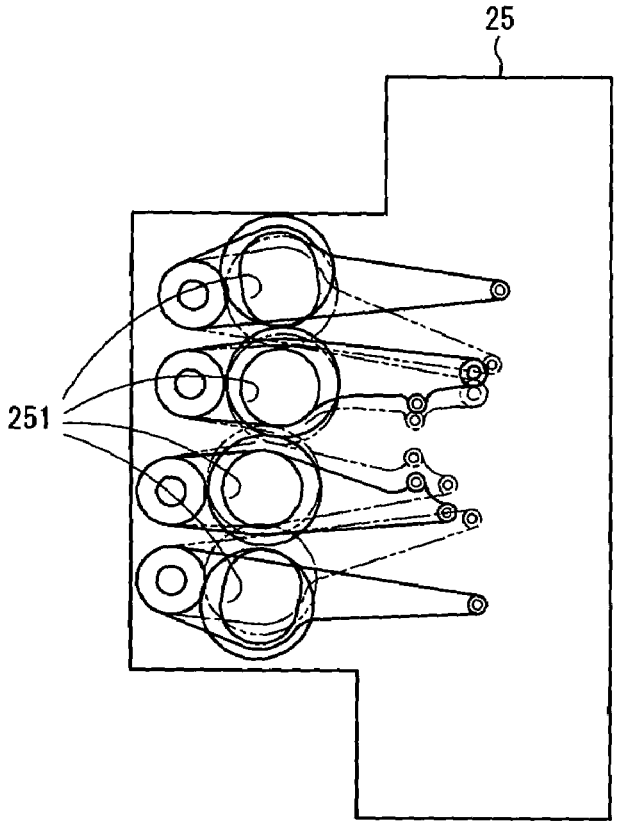
FIG. 11 is a diagram showing the positional relationship between holes, formed in the movable frame, and supporting arms.
Figure 12:
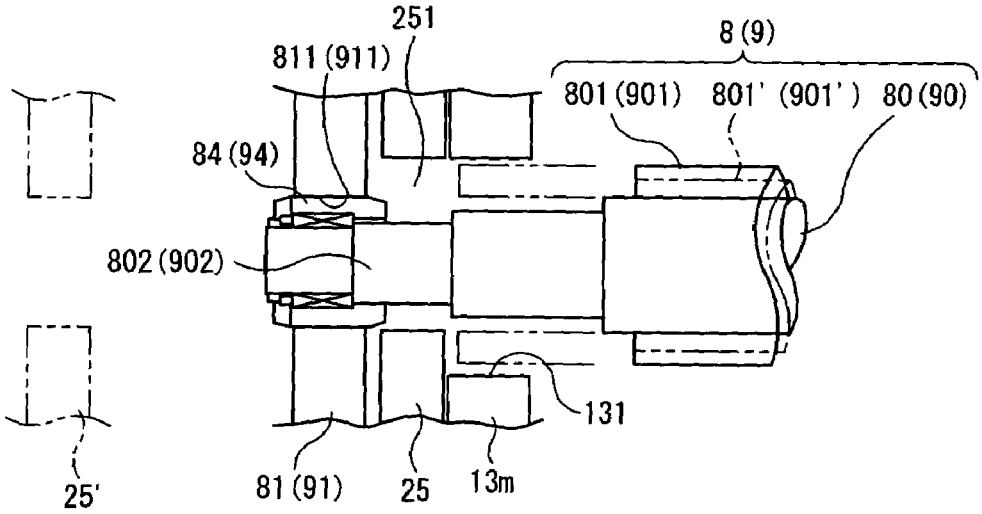
FIG. 12 is an enlarged view showing the manipulation-side end portion of the printing cylinder of FIG. 3.

As shown in FIG. 2, the main body of a lateral movement actuator 31 is fixed to the stationary bracket 26, and one end of the rod 311 engages with the lateral movement bracket 27. If the lateral movement actuator 31 is operated and the rod 311 projects from the actuator 31, the lateral movement bracket 27 holding the movable frame 25 is moved to a position indicated by a two-dot chain line in FIG. 2 (position of reference numeral 25"). The positional relationship between the movable frame 25 and side frame 13*m* at this time is shown in FIG. 10. As shown in the figure, if the movable frame 25 is moved in the lateral direction, there is nothing in front of a detaching hole 131 provided in the side frame 13*m*. The detaching hole 131 is used to take out the sleeves 801, 901 when changing the diameter of each of the printing cylinders 8, 9, as shown in FIG. 12. The detaching hole 131 is set to a size such that sleeves 801, 901 of any diameter can pass through the hole. Also, the movable frame 25 is provided with holes 251, which correspond to the positions of the printing cylinders 8, 9, as shown in FIGS. 11 and 12. The bearings 84 and 94 mounted on the shaft ends of the printing cylinders 8 and 9 are inserted in the printing-cylinder supporting arms 81, 91 through the holes 251. The holes 251 is set to a size such that even when the printing cylinders 8, 9 are held in any position, the bearings 84, 94 or printing-cylinder shafts 802, 902 will not strike the movable frame 25.

Between the lateral movement bracket 27 and the movable frame 25, there is provided a direct-acting bearing 28 for moving the movable frame 25 in the direction of the printing-cylinder shaft 802 or 809. The direct-acting bearing 28 for axial movement consists of a rail 281 and a bed 282. The rail 281 is fixed on the lateral movement bracket 27, and the bed 282 is fixed on the movable frame 25. Thus, the lateral movement bracket 27 holding the movable frame 25 can cause the movable frame 25 to move in the direction of the printing-cylinder shaft 802 or 809 with a high degree of accuracy.

Figure 7:
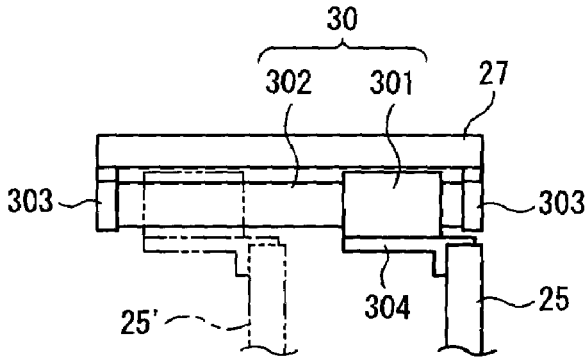
FIG. 7 is a view taken along line V—V of FIG. 2.

The lateral movement bracket 27 is provided with axial movement actuators 30, as shown in FIG. 2. Each axial movement actuator 30 consists of a mover 301 and a cylinder tube 302, as shown in FIG. 7. If the axial movement actuator 30 is operated, the mover 301 slides along the cylinder tube 302. The opposite ends of the cylinder tube 302 are fixed to the lateral movement bracket 27 through cylinder-fixing brackets 303, and the mover 301 is fixed to the movable frame 25 through a connecting bracket 304. Thus, if the axial movement actuator 30 is operated and the mover 301 moves, the movable frame 25 moves in the Y direction of FIG. 6 with respect to the side frame 13*m*. In FIG. 7, the axial movement actuator 30 is constructed of a magnet-type rod-less air cylinder, but it is not limited to that air cylinder.

Figure 8:
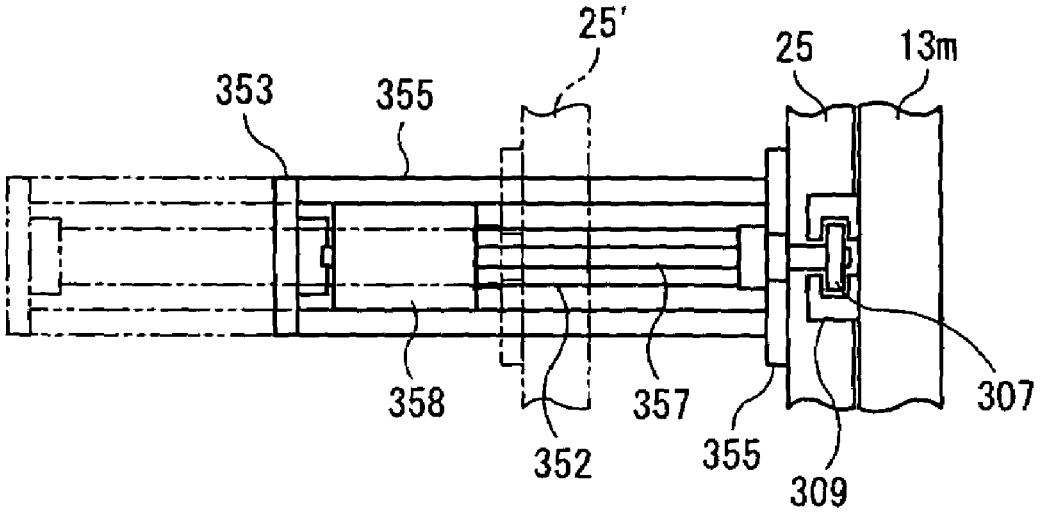
FIG. 8 is a view taken in the direction of VI of FIG. 2.
Figure 9:
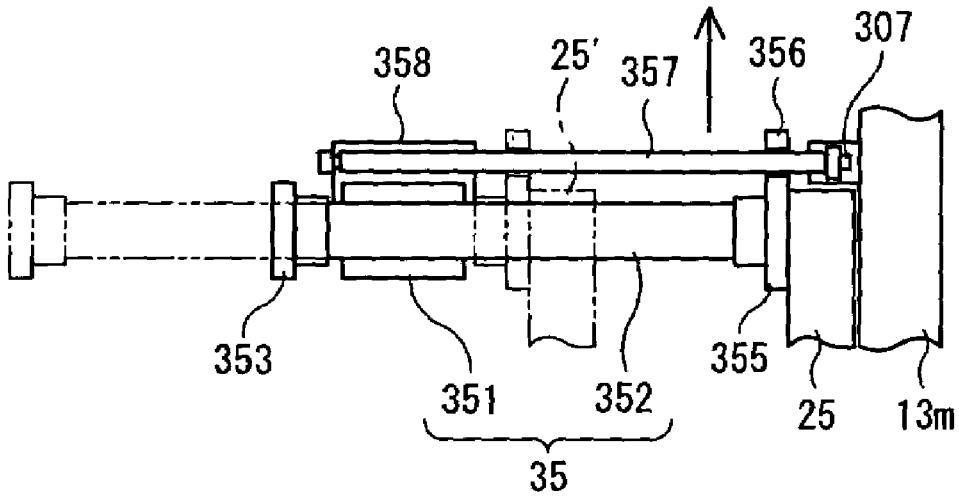
FIG. 9 is a view taken in the direction of VII of FIG. 2.

In addition to the above-described axial movement actuators 30, the movable frame 25 is provided with second axial movement actuators 35, as shown in FIGS. 2 and 6. Each axial movement actuator 35 operates only when the movable frame 25 is not moving in the lateral direction, and is constructed as shown in FIGS. 8 and 9. FIG. 8 shows the second axial movement actuator 35 taken in the direction of VI of FIG. 2; FIG. 9 is a view taken in the direction of VII of FIG. 2. The second axial movement actuator 35 consists of a mover 351 and a cylinder tube 352. If the second axial movement actuator 35 operates, the mover 351 slides along the cylinder tube 352. The cylinder tube 352 is mounted on the movable frame 25 through cylinder-fixing brackets 353, 355. The mover 351 has a stationary member 358 mounted thereon. The stationary member 358 is mounted on a rod 357 having a protruding portion 307. If the axial movement actuator 35 operates, the rod 357 moves in the direction of the printing-cylinder shaft. The protruding portion 307 of the rod 357 engages with a recessed member 309 mounted on the side frame 13*m* when the movable frame 25 is not moving in the lateral direction. If the rod 357 is moved by operation of the axial movement actuator 30, the protruding portion 307 pushes the side frame 13*m* through the recessed member 309, and the reaction causes the movable frame 25 to move in the direction of the printing-cylinder shaft. The recessed member 309 engages with the protruding portion 307 only when the movable frame 25 is not moving in the lateral direction. If the axial movement actuators 30, 35 operate and the movable frame 25 moves to a position indicated by a two-dot chain line in FIG. 8 (position indicated by reference numeral 25') and moves in an arrow-indicating direction shown in FIG. 9 (X direction in FIG. 2), the protruding portion 307 can move smoothly.

As shown in FIG. 6, the movable frame 25 is provided with a frame-positioning pin 33. The end portion of the frame-positioning pin 33 projects from the movable frame 25 and is tapered. The side frame 13*m* has a frame-positioning hole 34. If the frame-positioning pin 33 is fitted in the frame-positioning hole 34, the position of the movable frame 25 in the operating state can be accurately determined. Although not shown, the center-of-swing shafts 82, 92 of the printing-cylinder supporting arms 81, 91 of each of the printing cylinders 8, 9 are likewise passed through holes in the movable frame 25 and project toward the side frame 13*m*. The projected end portions of the shafts 82, 92 are tapered. And in the operating state, the projected end portions of the center-of-swing shafts 82, 92 are similarly fitted in positioning holes formed in the side frame 13*m*.

In the rotary press of this embodiment, when changing the diameter of each of the printing cylinders 8, 9 (for example, when changing to the printing cylinders 8*a*, 8*b*, 9*a*, and 9*b* greater in diameter than printing cylinders 8'*a*, 8'*b*, 9'*a*, and 9'*b*), the printing-cylinder supporting arms 81, 91 are swung in a direction away from the web 11 by the supporting-arm actuators 83, 93 to form wide spaces between the printing cylinders 8*a*, 8*b*, 9*a*, and 9*b*. At this time, the position adjustment member 161 is moved to a regulated position corresponding to the diameter of the printing cylinders 8*a*, 8*b* to be installed by the adjustment-member actuator 162 (that is, in FIG. 2 the position adjustment member 161 is moved from the position indicated by a two-dot chain line to the position indicated by a solid line), and is held in that position. Also, the plate-cylinder position adjustment members 181*a*, 181*b* are moved to regulated positions corresponding to the diameter of the printing cylinders 9*a*, 9*b* to be installed by the second adjustment-member actuators 182*a*, 182*b* (that is, in FIG. 2 the plate-cylinder position adjustment members 181*a*, 181*b* are moved from the positions indicated by two-dot chain lines to the positions indicated by solid lines), and are held in those positions.

Next, the axial movement actuators 30, 35 are operated and the movable frame 25 is moved to the position indicated by a two-dot chain line in FIG. 6 (position indicated by reference numeral 25') by the axial frame-moving devices (axial movement actuators 30, 35, axial direct-acting bearing 28, etc.). At this time, the movable frame 25 does not have to detach the printing-cylinder supporting arms 81, 91, supporting-arm cylinders 83, 93, adjusting mechanism (not shown), etc., and only the printing-cylinder supporting arms 81, 91 are detached from the bearings 84, 94 of the printing cylinders 8, 9. It is easy to detach the printing-cylinder supporting arms 81, 91 from the bearings 84, 94. That is, the printing-cylinder supporting arms 81, 91 slide in the direction of the printing-cylinder shaft between bearing holes 811, 911 (see FIG. 12) and the outer peripheries of the bearings 84, 94, and the printing cylinders 8, 9 are supported by the drive-side side frame 13*d*. Therefore, if only the movable frame 25 is moved in the direction of the printing-cylinder shaft, the printing-cylinder supporting arms 81, 91 can be easily detached from the bearings 84, 94.

After the movable frame 25 has been moved to the position indicated by reference numeral 25' in the direction of the printing-cylinder shaft, the lateral movement actuator 31 is operated and the movable frame 25 is moved to the two-dot chain line position (position indicated by reference numeral 25") shown in FIG. 2 by the lateral movement mechanism (lateral movement actuator 31, lateral movement bracket 27, lateral direct-acting bearing 29, etc.). At this time, the position in the cylinder-axis direction of the movable frame 25 is held in the position indicated by reference numeral 25' in FIG. 6. In this state, there is nothing in front of the detaching hole 131 of the side frame 13*m*, as shown in FIG. 10. This makes it possible to detach and interchange the sleeves 801, 901 of the printing cylinders 8, 9. After the sleeves 801, 901 have been interchanged, the movable frame 25 is returned to the original position in the reverse order, whereby the rotary press is caused to be in an operating state. At this time, the frame-positioning pins 33 are fitted in the frame-positioning holes 34, so the movable frame 25 can be positioned again with a high degree of accuracy.

After the interchange of the printing cylinders 8*a*, 8*b*, 9*a*, and 9*b* has been completed as described above, the printing-cylinder supporting arms 81, 91 are swung toward the web 11 by supporting-arm actuators 83, 93 so that they are brought into contact with the position adjustment members 161, 181. That is, the printing cylinders 8*a*, 8*b*, 9*a*, and 9*b* are roughly positioned (rough adjustment) . Thereafter, the blanket-cylinder position adjustment member 161 is moved back and forth by the adjustment-member actuator 162 to change the position between the arm-abutting surface 161C and roller followers 911*a*, 911*b*, whereby the positions of the blanket cylinders 9*a*, 9*b* are finely adjusted. Also, the plate-cylinder position adjustment members 181*a*, 181*b* are projected or retracted by the second adjustment-member actuators 182*a*, 182*b*, whereby the positions of the plate cylinders 8*a*, 8*b* are finely adjusted.

Thus, according to the rotary press of this embodiment, printing cylinders can be detached by only moving the movable frame 25 in two stages. That is, the number of steps required for changing the diameter of each of the printing cylinders 8, 9 is considerably reduced and the steps are automatically performed. Thus, printing cylinders can be interchanged in a short time with less lobar, and productivity can be considerably enhanced.

The restoration of the movable frame 25 to the original position can be accurately performed by the frame-positioning pins 33 and frame-positioning holes 34. Because the center-of-swing shafts 82, 92 of the printing-cylinder supporting arms 81, 91 are fitted in the tapered holes in the side frame 13*m*, the restoration of the principal part of the rotary press to the original position can be performed with a high degree of accuracy and print quality can be kept high.

According to the rotary press of this embodiment, the main body (cylinder body) of the printing cylinder 8 or 9 is formed integrally with the shaft, so the opposite ends of the main body are supported. Therefore, bending moment that is applied to the printing-cylinder supporting arms 81, 91, 85, and 95 can be reduced compared with the case where a printing cylinder and a supporting shaft are formed from two separate members. Thus, the printing-cylinder supporting arms 81, 91, 85, and 95 can be reduced in size.

With the applied-pressure adjusters 160, 180*a*, and 180*b*, the applied pressure between the plate cylinder 8*a* and blanket cylinder 9*a*, applied pressure between the blanket cylinder 9*a* and blanket cylinder 9*b*, and applied pressure between the blanket cylinder 9*b* and plate cylinder 8*b* can be finely adjusted to desired pressure.

As described above, the attachment and detachment of the printing cylinders and the applied-pressure adjustment are performed by separate actuators. Therefore, if the supporting-arm actuators 83, 93 are constructed of high-speed actuators that can project and retract a rod at high speeds, the attachment and detachment of the printing cylinders can be quickly performed. Also, if the first adjustment-member actuators 162 and second adjustment-member actuators 182*a*, 182*b* drive the screws 163, 183*a*, and 183*b* at a slower speed than the supporting-arm actuators 83, 93, applied pressure can be finely adjusted.

The attachment and detachment of the printing cylinders can be performed at high speeds. Therefore, for example, the time for the printing cylinders to go from the state of the start of printing to the steady operating state can be reduced. Since the cylinder-detaching timing with another printing press unit can be adjusted at the end of printing, quality printing can be performed to the very last sheet without wasting paper. As applied pressure can be finely adjusted, printing is always performed under optimum printing conditions and therefore quality printing becomes possible.

According to this embodiment, the position adjustment member 161 is easy to install even when there is no wide space between the printing-cylinder supporting arms 91*a* and 91*b*.

In the case where printing cylinders are escaped to interrupt printing, the printing-cylinder supporting arms 81, 91 are quickly swung in a direction away from the web 11 by the supporting-arm actuators 83 and 93 so that a gap is formed between the blanket cylinders 9*a* and 9*b*. On the other hand, in the case where printing cylinders are installed to start printing, the printing-cylinder supporting arms 81, 91 are quickly swung toward the web 11 by the supporting-arm actuators 83 and 93 so that the blanket cylinders 9*a* and 9*b* abut each other across the web 11.

Figure 22A:
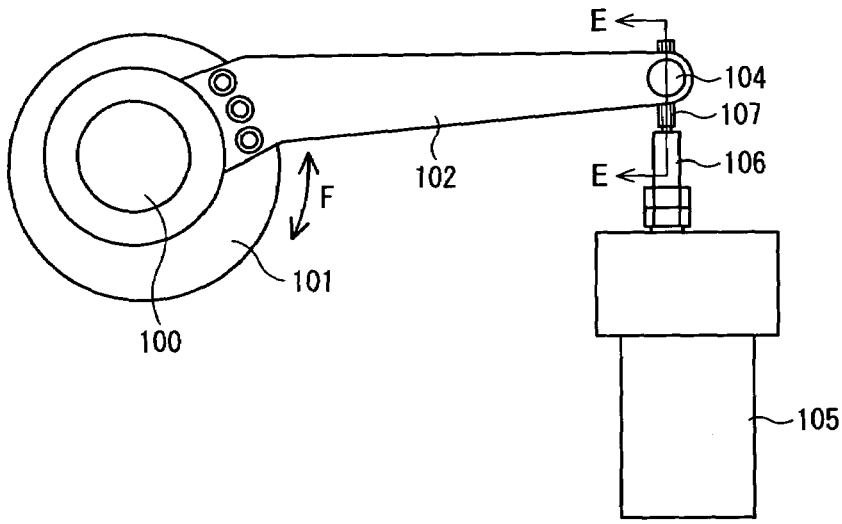
FIG. 22A is a schematic diagram showing a conventional applied-pressure adjuster employing an eccentric bearing.
Figure 22B:
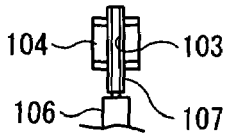
FIG. 22B is a sectional view taken along line E—E of FIG. 22A.

In a conventional applied-pressure adjuster, the shaft 100 of the plate cylinder 8 or blanket cylinder 9 is typically supported on an eccentric bearing 101, as shown in FIGS. 22A and 22B. The eccentric bearing 101 is rotated to adjust a gap between the printing cylinders, whereby applied-pressure adjustment and cylinder escape are performed. In this device, one end portion of a lever 102 is mounted on the eccentric bearing 101, while the other end portion is provided with a pin 104 having a female screw 103. The output shaft 106 of a motor 105 with a speed reducer is coupled with an adjusting pin 107, which meshes with the female screw 103. If the motor 105 is driven to rotate the adjusting pin 107, the eccentric bearing 101 swings in the direction of arrow F in FIG. 22A. Such a technique is disclosed, for example, in Japanese Laid-Open Patent Publication Nos. HEI 6-297677 (patent document 3) and HEI 9-76453 (patent document 4). Note that the eccentric bearing 101 is mechanically adjusted by human hand without using the motor 105.

Although not shown, in Japanese Laid-Open Patent Publication No. 2001-353843 (patent document 5), an eccentric bearing for cylinder attachment and detachment is provided on the outside diameter side of the bearing of a printing cylinder, and an eccentric bearing for applied-pressure adjustment is provided outside that eccentric bearing. The two eccentric bearings are rotated by two separate actuators, whereby applied-pressure adjustment and cylinder escape are performed.

Figure 23:
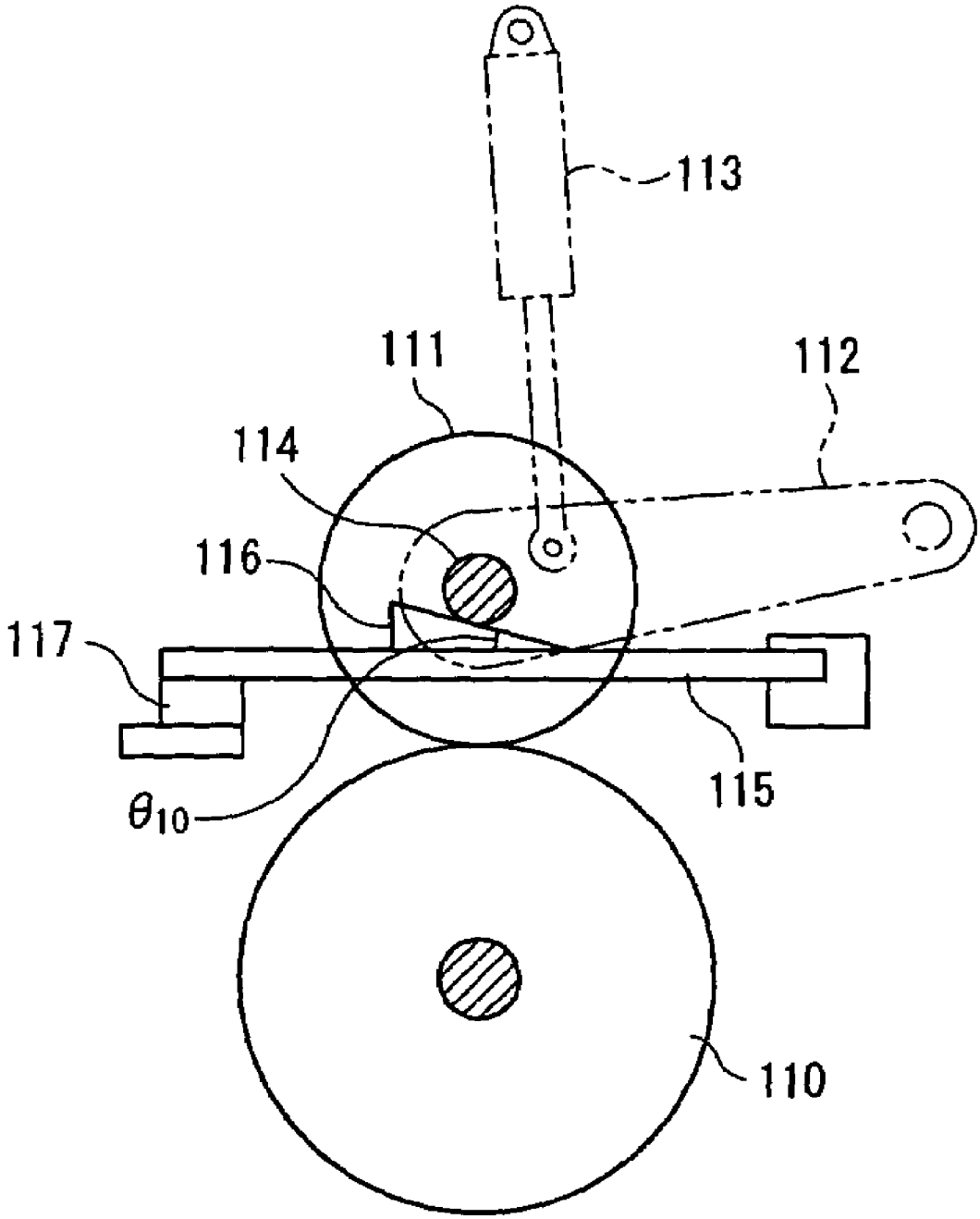
FIG. 23 is a schematic diagram showing another conventional applied-pressure adjuster.
Figure 24:
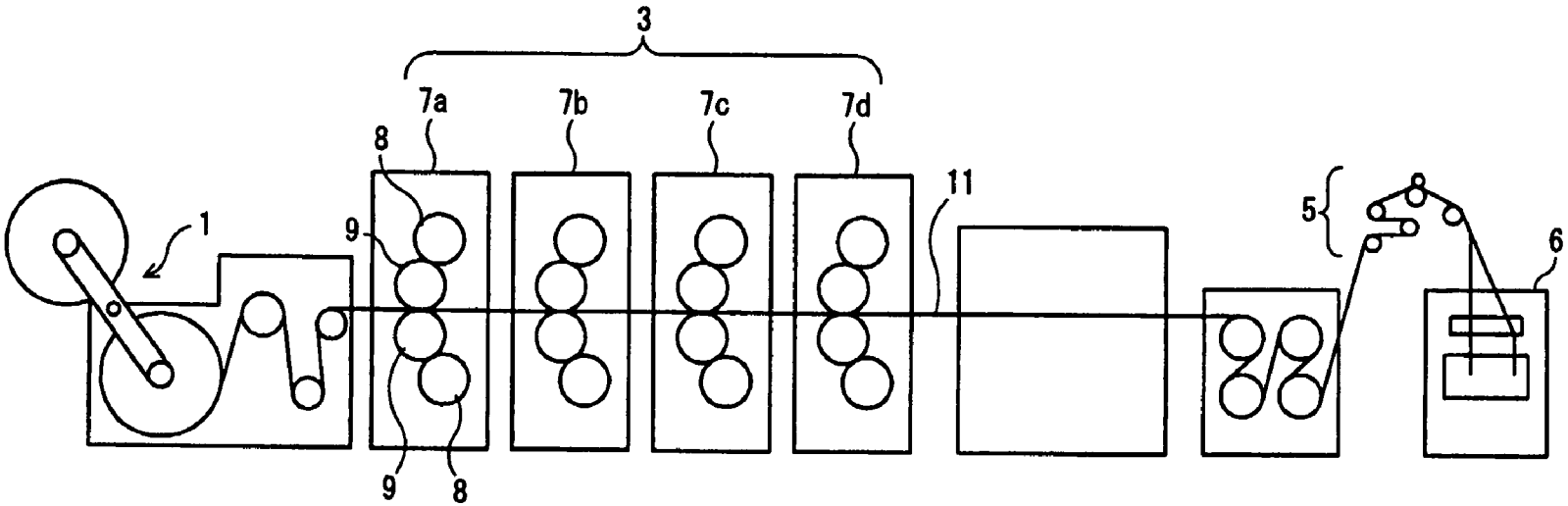
FIG. 24 PRIOR ART
FIG. 24 is a schematic diagram showing an example of a rotary press.
Figure 25:
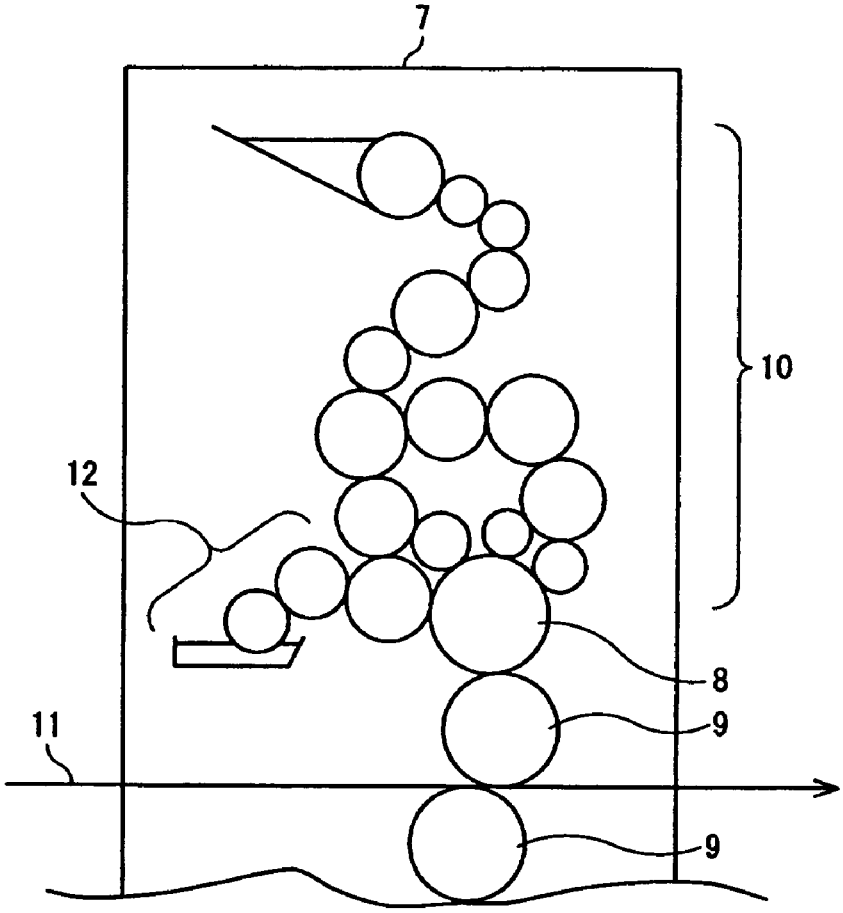
FIG. 25 PRIOR ART
FIG. 25 is a schematic diagram showing a typical printing unit provided in the rotary press.
Figure 26:
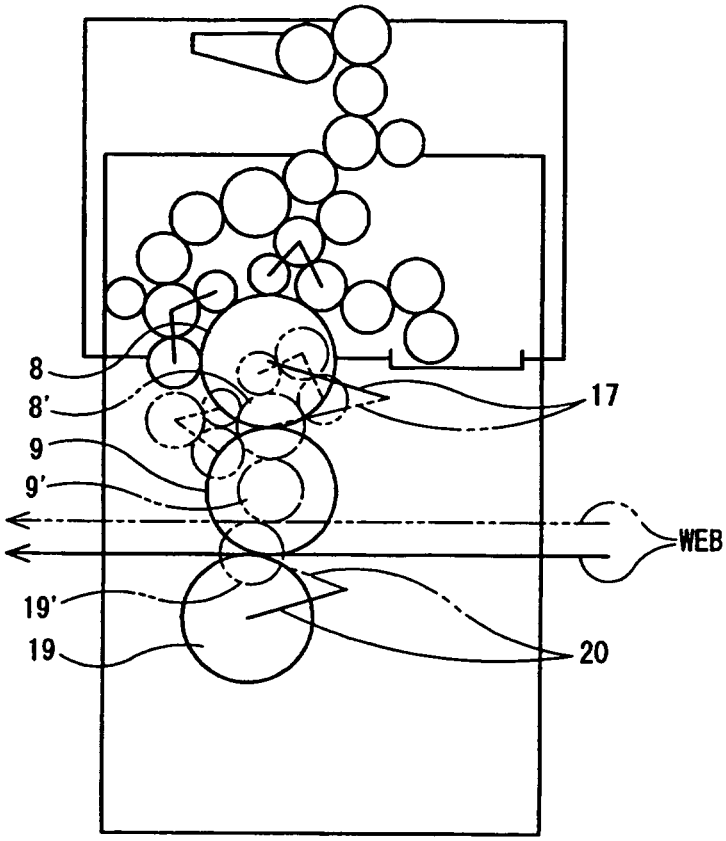
FIG. 26 PRIOR ART
FIG. 26 is a schematic diagram showing a rotary press disclosed in the patent document 1.
Figure 27:
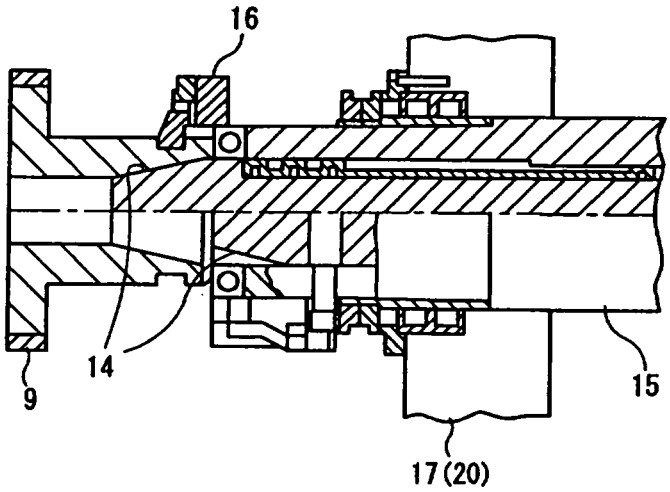
FIG. 27 PRIOR ART
FIG. 27 is a sectional view showing the supporting mechanism of the printing cylinder disclosed in the patent document 1.
Figure 28:
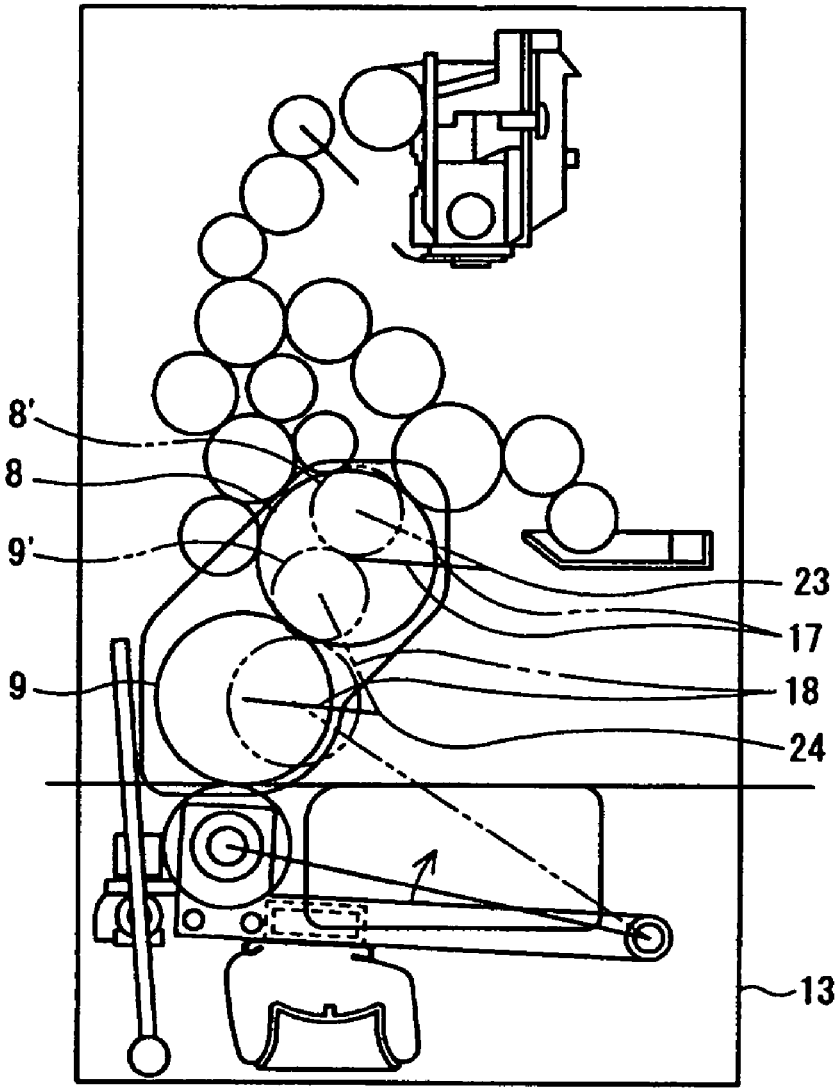
FIG. 28 PRIOR ART
FIG. 28 is a schematic diagram showing a rotary press disclosed in the patent document 2.
Figure 29:
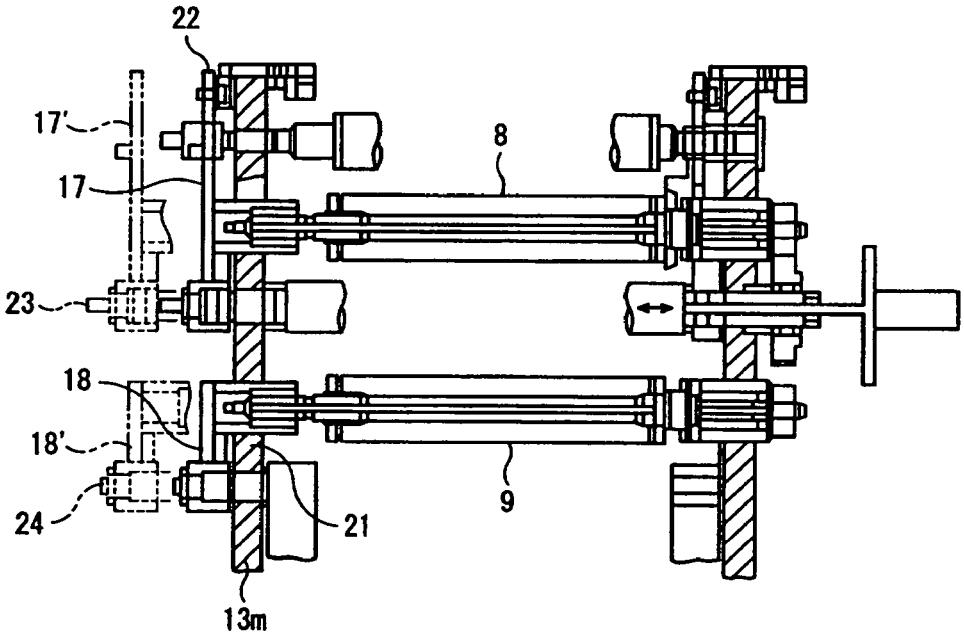
FIG. 29 PRIOR ART
FIG. 29 is a sectional view showing a supporting mechanism disclosed in the patent document 1.
Figure 30:
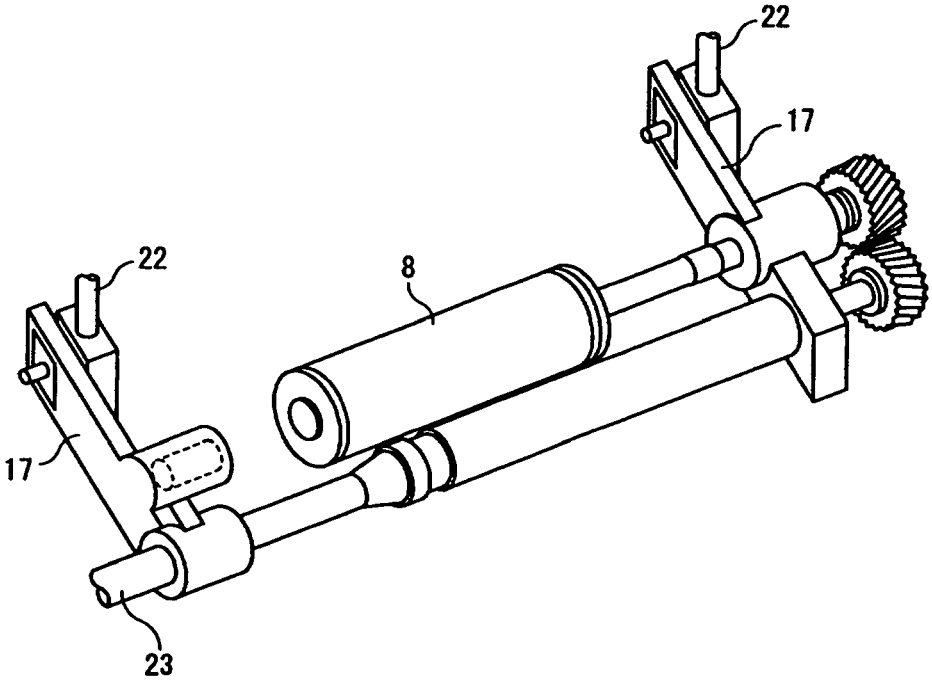
FIG. 30 PRIOR ART
FIG. 30 is a perspective view showing the supporting mechanism disclosed in the patent document 2.

As shown in FIG. 23, Japanese Patent Publication No. 2715389 (patent document 6) discloses another conventional applied-pressure adjuster, which includes a stationary roll 110 held so as to rotate at a fixed position, a movable roll 111 held by a swinging arm 112 and contacts with a stationary roll 110, and a press device 110 that presses a movable roll 111 against the stationary roll 110 by swinging an arm 112. The adjuster also includes a supporting bed 115 for supporting the shaft 114 of the movable roll 111 against the pressing force of the press device 113, provided in a direction crossing the direction of contact pressure between the rolls 110 and 111. The adjuster further includes a wedge member 116 provided between the supporting bed 115 and shaft 114, and a load detector 117 for detecting a load applied to the supporting bed 115. The applied pressure between the stationary roll 110 and movable roll 111 is adjusted to desired pressure by changing the position of the wedge member 116, based on the detection information from the load detector 117.

In the techniques disclosed in the patent documents 3, 4, and 5, adjusting applied pressure finely by the eccentric bearing is possible. However, in the case where the plate cylinder 8 or blanket cylinder 9 differing in diameter is used, the cylinder needs to be moved by the amount corresponding to a change in diameter, so the eccentric amount must be further increased. Because of this, the amount that the eccentric bearing is moved becomes extremely great and therefore installation is structurally difficult.

In the technique disclosed in the patent document 6, when adjusting applied pressure finely, the inclined angle $\theta_{10}$ of the wedge portion 116 shown in FIG. 23 has to be made as small as possible. However, for instance, when the movable roll 111 is interchanged with one greater in diameter, the position of the shaft 114 of the movable roll 111 is greatly moved upward. If the shaft 114 is supported at the moved position by the wedge member 116, the wedge member 116 must be greatly moved. In effect, such movement is structurally difficult. Therefore, in variable cut-off rotary presses, this technique is practically unsuitable for applied pressure adjustment. According to the applied pressure adjusters 160, 180*a*, and 180*b* of this embodiment, as described above, when printing cylinders are interchanged with ones differing in diameter, the printing-cylinder supporting arms abut the arm-abutting surfaces corresponding to the diameters after interchange, whereby the positions of the printing cylinders are determined. Further, if the position adjustment member is moved, the fine adjustment of the positions of the printing cylinders can be performed. For example, this renders it possible to finely adjust the applied pressure between two printing cylinders that abut each other. Thus, even when printing cylinders are interchanged with ones differing in diameter, fine adjustment can be quickly performed and it becomes possible to easily solve the problems found in the prior art (patent documents 3 to 6). Since conventional eccentric bearings are not needed, the device itself can be made compact. In addition, the structure is simple compared with the eccentric bearings, so costs can be reduced and the operation efficiency of assembly, disassembly, and maintenance can be enhanced.

(B) Second Embodiment

Figure 13:
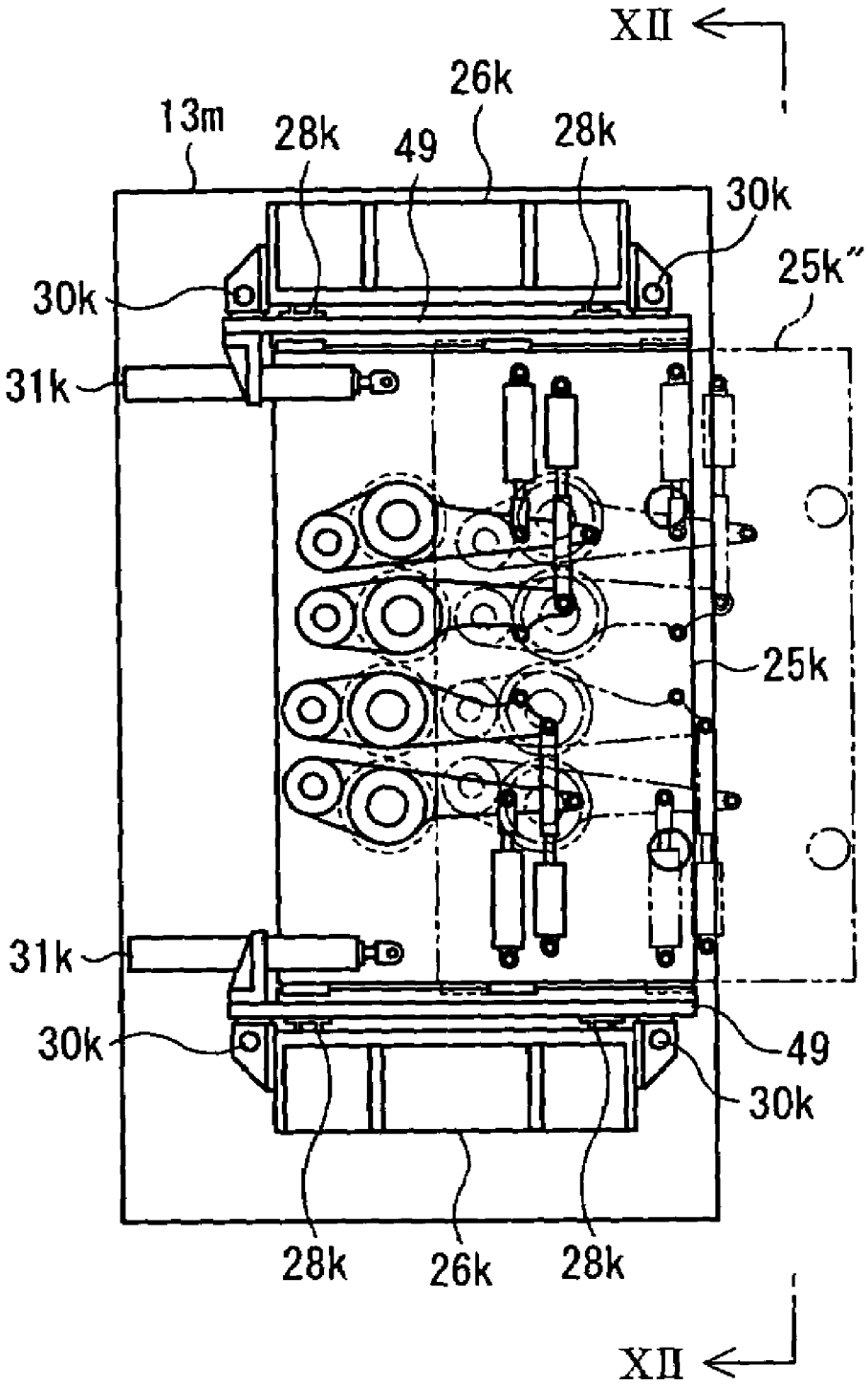
FIG. 13 is a side view showing a printing unit constructed in accordance with a second embodiment of the present invention.
Figure 14:
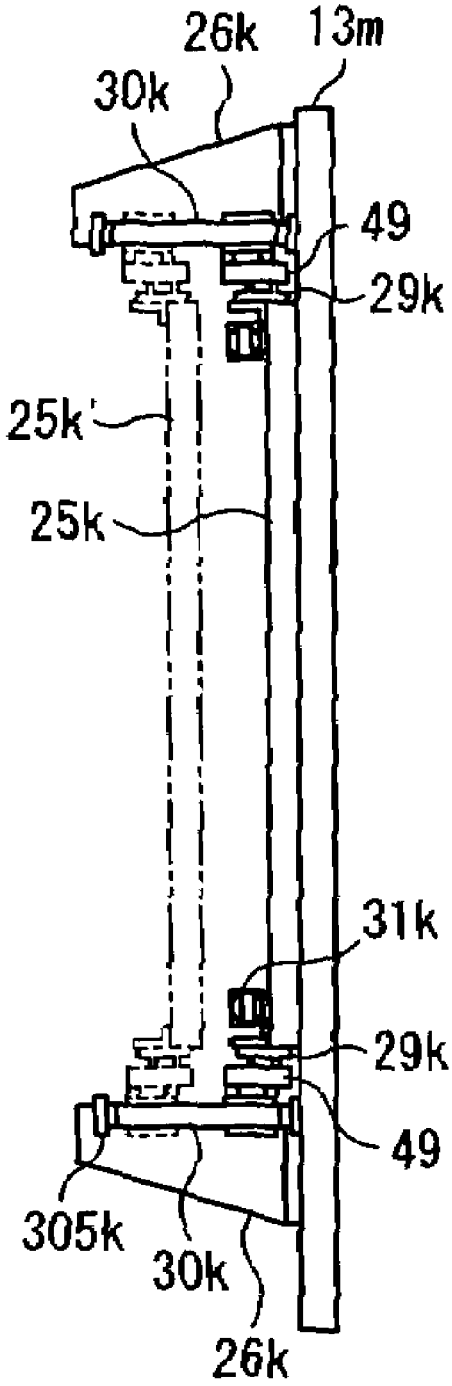
FIG. 14 is a view taken along line XII—XII of FIG. 13.

Referring to FIGS. 13 and 14, there is shown a printing unit constructed in accordance with a second embodiment of the present invention. The parts or members at the same positions as the aforementioned first embodiment are represented by the same reference numerals.

This embodiment differs from the first embodiment in that a movable frame is supported by a side frame. That is, as shown in FIGS. 13 and 14, stationary brackets 26*k* fixed to a side frame 13*m* are provided with axial direct-acting bearings 28*k*, and axial movement brackets 49 are supported through the axial direct-acting bearings 28*k*. And a movable frame 25*k* is supported by the axial movement brackets 49 through lateral direct-acting bearings 29*k*. The side frame 13*m* is connected with the axial movement bracket 49 by an axial movement actuator 30*k*. The axial movement bracket 49 is connected with the movable frame 25*k* by a lateral direct-acting actuator 31*k*. Thus, operation of the axial movement actuators 30*k* causes the movable frame 25*k* to move in the axial direction, along with the axial movement brackets 49. Operation of the lateral movement actuators 31*k* makes the movable frame 25*k* move in the lateral direction.

In the first embodiment, the movable frame 25 can be moved in the axial direction by the lateral movement brackets 27 supported by the side frame 13*m*, while in the second embodiment the axial movement brackets 49 are supported by the side frame 13*m* and the movable frame 25*k* can be moved in the lateral direction by the axial movement brackets 49. Thanks to this, in addition to the same advantages as the first embodiment, the selection of axial movement actuators is increased and the axial movement actuator 30 becomes easy to design.

(C) Third Embodiment

Figure 15:
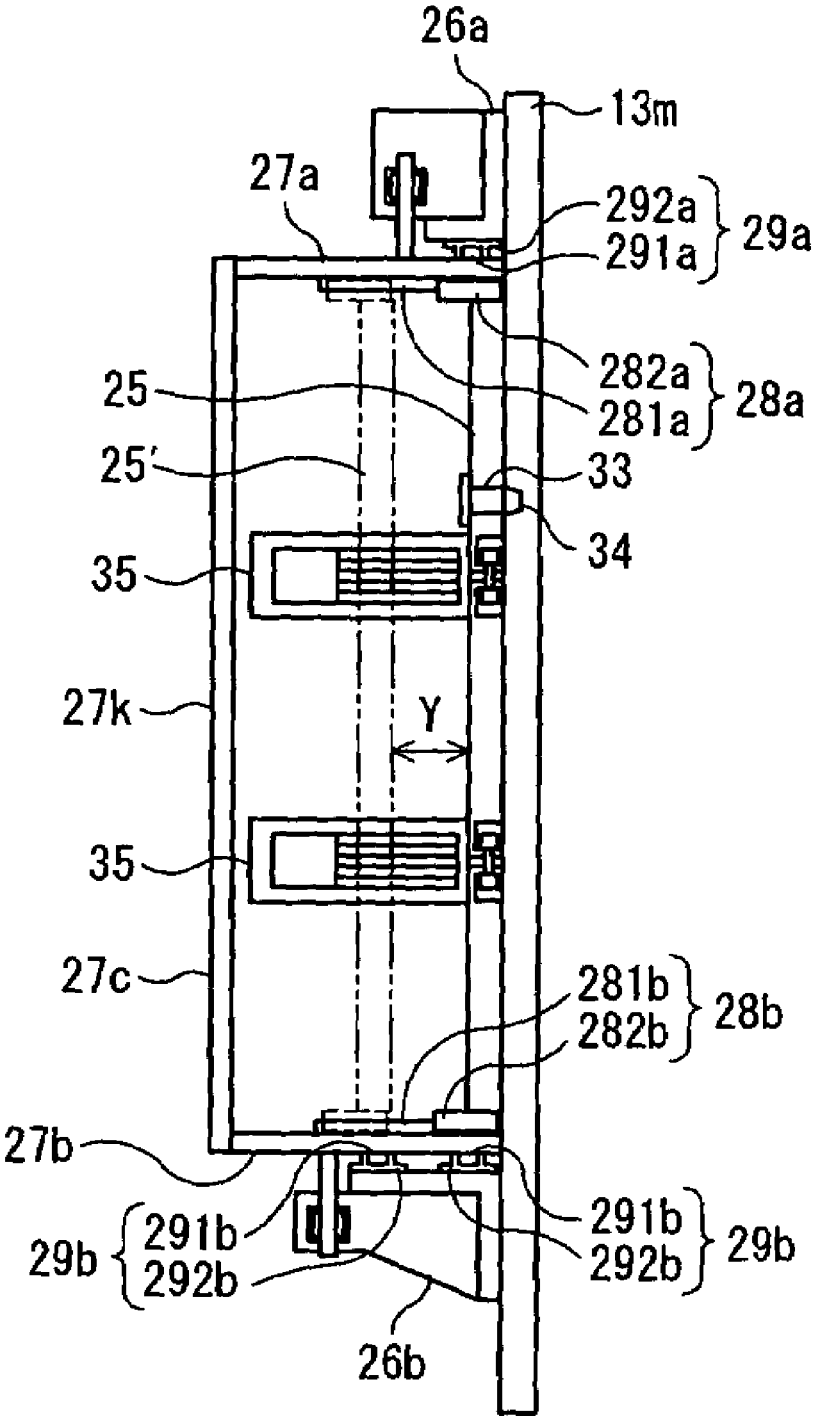
FIG. 15 is a part-front view showing a printing unit constructed in accordance with a third embodiment of the present invention.

Referring to FIG. 15, there is shown a printing unit constructed in accordance with a third embodiment of the present invention. The parts or members at the same positions as the aforementioned first embodiment are represented by the same reference numerals.

In this embodiment, lateral movement brackets differ in construction from the first embodiment. That is, in the first embodiment, the lateral movement brackets 27*a*, 27*b* are separated from each other. On the other hand, in the third embodiment, lateral movement brackets 27*a*, 27*b* are connected by a connection member 27C, and they are integrally formed as one lateral bracket 27*k*. Thanks to this, in addition to the same advantages as the fist embodiment, the connection member 27*c* can be used as a cover, and the two lateral movement actuators 31 can be reduced to one actuator. For example, the upper actuator can be omitted. Since supporting rigidity is increased, the printing-cylinder supporting arms 81, 91 can be easily fitted on the bearings 84, 94 at the time of restoration (see FIG. 12).

(D) Fourth Embodiment

Referring to FIGS. 16 to 21, there is shown a printing unit constructed in accordance with a fourth embodiment of the present invention. The parts or members at the same positions as the aforementioned first embodiment are represented by the same reference numerals.

Figure 16:
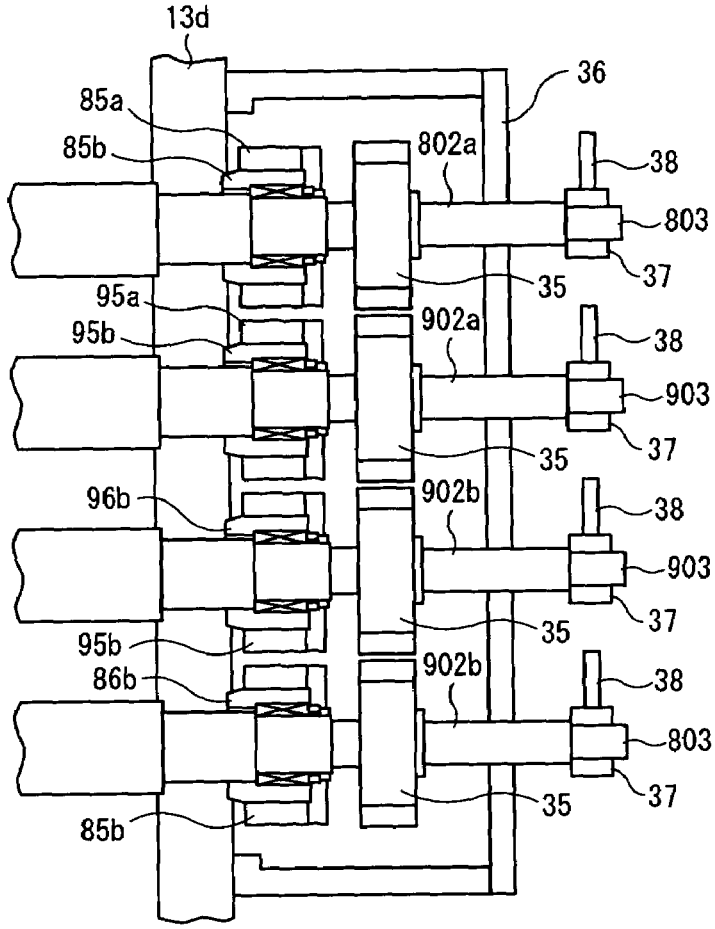
FIG. 16 is a sectional view showing the principal part of a printing unit constructed in accordance with a fourth embodiment of the present invention.

In addition to the construction of the first embodiment, this embodiment adopts a countermeasure against great load that is applied to the drive-side bearings 86, 89 when interchanging the printing cylinders 8, 9. That is, as shown in FIG. 12, the manipulation-side bearings 84, 94 of the printing cylinders 8, 9 are supported by the printing-cylinder supporting arms 81, 91, but when interchanging the sleeves 801, 901, the printing-cylinder supporting arms 81, 91 are detached from the bearings 84, 94 by axial movement of the movable frame 25. Because of this, the printing cylinders 8, 9 are supported by only the drive-side bearings 86, 89. At this time, the bearings 86, 96 undergo great load proportional to the weights of the printing cylinders 8, 9 by the principles of levers. Hence, in this embodiment, as shown in FIG. 16, the printing-cylinder shafts 802, 902 of the printing cylinders 8, 9 further extend through driving gears 35 arranged outside the bearings 86, 96, and have pressure-receiving members 37 mounted on the end portions 803, 903. Each of the pressure-receiving members 37 undergoes a pushing force by a pressure member 38.

Figure 20:
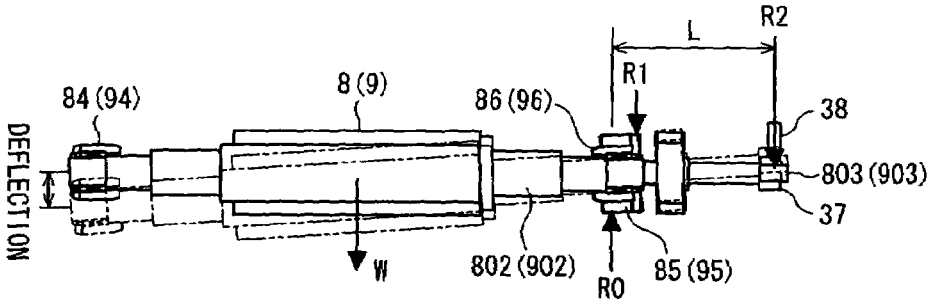
FIG. 20 is a schematic diagram showing the balance of forces acting on a shaft when interchanging a printing cylinder.
Figure 21:
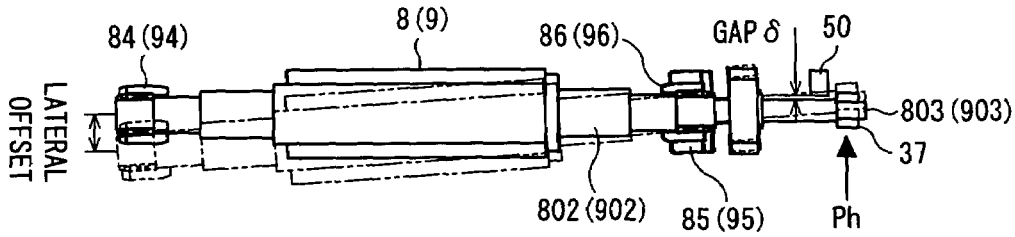
FIG. 21 is a schematic diagram showing the lateral offset of the printing cylinder that occurs when interchanging a printing cylinder.

The balance of forces at this time is shown in FIG. 20. When there is a fulcrum on the printing-cylinder side of the bearing 86 (96), and a pushing force R2 is not acting on the pressure-receiving member 37, the bending moment produced by reaction R1 acting on the driving-gear side of the bearing 86 (96) will balance with the bending moment produced by the weight W of the printing cylinder 8 (9). The reaction R1 applied on the driving-gear side of the bearing 86 (96) becomes extremely great because the distance to the fulcrum is very short, and the fulcrum undergoes an even greater reaction R0, which is equivalent to the sum of the reaction R1 and weight W. On the other hand, in the case where the printing-cylinder shaft 802 (902) undergoes the pushing force R2 at its outer end, as in this embodiment, the reaction R1 acting on the driving-gear side of the bearing 86 (96) becomes small, depending on the magnitude of the bending moment produced by the pushing force R2. If the bending moment to be applied to the fulcrum is the same, the pushing force R2 becomes smaller as the distance L from the fulcrum becomes longer. Therefore, the fulcrum undergoes the reaction R0 equivalent to the sum of the weight W of the printing cylinder 8 (9), reaction R1, and pushing force R2, but the reaction R0 can be made small if the distance from the fulcrum to the pushing force R2 is long.

Figure 17:
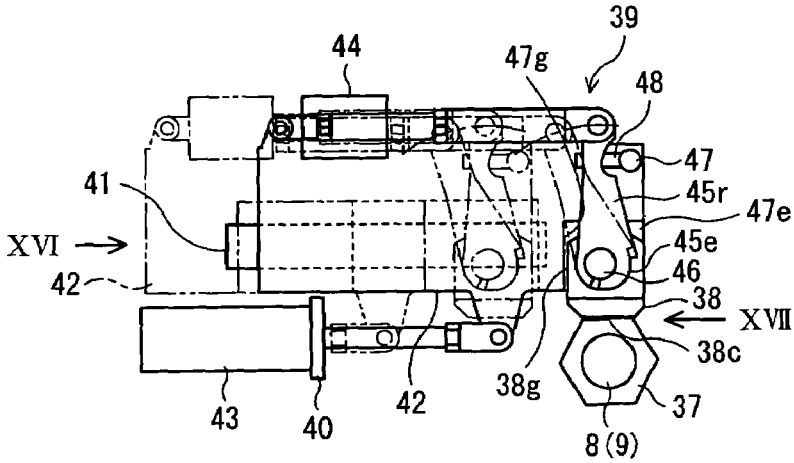
FIG. 17 is a diagram showing the pressure device of the fourth embodiment.
Figure 18:
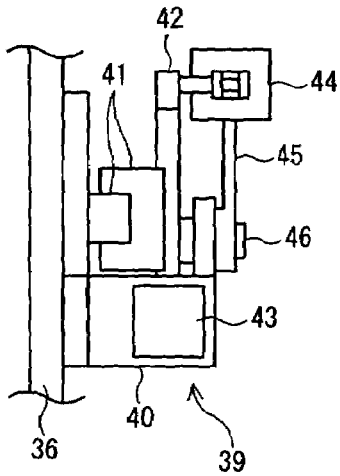
FIG. 18 is a view taken in the direction of XVI of FIG. 17.
Figure 19:
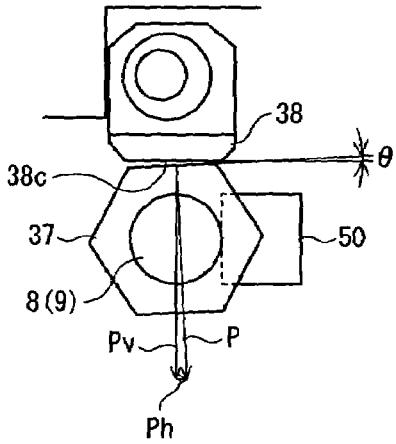
FIG. 19 is a view taken in the direction of XVII of FIG. 17.

The pressure device for applying a pushing force, and the pressure-receiving member that undergoes the pushing force, are shown in FIGS. 17 to 19. First, the pressure-receiving member 37 has an inner peripheral portion, which is circular in shape and is rotatably supported on the shaft end portion 803 (903). The outer peripheral portion is formed into a polygon with a plurality of flat surfaces (in the figures, a hexagon), which surface-contacts with the pressure surface 38*c* of the pressure member 38 described later.

The pressure device 39 is supported to an intermediate frame 36, as shown in FIG. 17. The intermediate frame 36 is firmly attached to the drive-side side frame 13*d* whose rigidity is high, as shown in FIG. 16. As shown in FIG. 17 or 18, the bracket 40 of the pressure device 39 is firmly attached to the intermediate frame 36 and is provided with a movable plate 42 through a direct-acting bearing 41. The movable plate 42 is moved by an actuator 43 whose main body is supported to the bracket 40.

The movable plate 42 is equipped with a pressure mechanism. More specifically, the movable plate 42 has a pin 46 on which a lever 45 is swingably supported. The lever 45 consists of an eccentric portion 45*e* eccentrically mounted on the pin 46, and a lever portion 45*r* extending from the eccentric portion 45*e*. The outer periphery of the eccentric portion 45*e* is circular in shape and has the pressure member 38 rotatably supported thereon. The pressure member 38 is arranged within an inverted L-shaped housing portion 47*e*, which is formed in the lower portion of the movable plate 42. The swing of the lever 45 causes the pressure member 38 to rotate within the housing portion 47*e*. The pressure member 38 is quadrilateral in cross section and has chamfered corners. If the pressure member 38 is moved within the housing portion 47*e*, one side surface 38*g* strikes the wall surface 47*g* of the housing portion 47*e*. This regulates rotation of the press member 38, whereby it moves vertically along the wall surface 47*g* in proportion to the eccentric amount of the eccentric portion 45*e* relative to the shaft 46. Since the press member 38 moves slightly in a lateral direction when moved vertically, there is provided a gap between the side surface 38*g* of the pressure member 38 and the wall surface 47*g* of the movable plate 42.

The swing of the lever 45 is performed by operation of the pressure actuator 44. The tip end of the rod of the pressure actuator 44 is coupled with the movable plate 42, while the cylinder is coupled with the tip end of the lever portion 45*r* of the lever 45. Therefore, if the actuator 44 is operated, the lever 45 swings and the pressure member 38 moves up and down. The side portion of the lever 45 is formed so that it can abut a stopper 47 firmly attached to the movable plate 42. The stopper corresponding portion of the lever 45 has an adjustment screw 48. The swing of the lever 45 is regulated by the stopper 47, but the projected length of the adjustment screw 48 can adjust the position in the swing direction of the lever 45. Thus, the pressure position (lower limit position) of the pressure member 38 relative to the pressure-receiving member 37 can be finely adjusted.

As shown in FIG. 19, the pressure surface 38*c* of the bottom surface of the pressure member 38 is formed so that within a plane perpendicular to the axis of the printing cylinder 8 (9), a perpendicular line to the pressure surface 38*c* inclines toward the direction where the pressure device 39 is pushed out by the actuator 43, by an angle θ relative to the direction where pressure is applied. Therefore, when the pressure device 39 is pushed out from the retracted position (position where the cylinder of the actuator 43 is retracted) to the position where pressure is applied, the pressure member 38 is brought into contact with the outer peripheral portion of the pressure-receiving member 37 and rotates the pressure-receiving member 37, whereby the pressure surface 38*c* of the pressure member 38 contacts with any one of the flat surfaces of the pressure-receiving member 37.

In addition, this embodiment has the following advantage because it is capable of performing the attachment and detachment of the printing cylinder at high speed. That is, when the web 11 is cut during printing, the rotary press is urgently stopped automatically by detecting web cutting, but the web 11 is often wrapped around the blanket cylinder during the period from web cutting to stoppage (about 10 seconds) Because the diameter of the blanket cylinder is increased by the web 11 being wrapped around it, the printing cylinder must be moved quickly so that a gap is formed between the two cylinders. If the movement of the printing cylinder is later than an increase in the diameter of the blanket cylinder that is caused by the web 11 wrapped around the blanket cylinder, there is a possibility that the printing cylinder will be damaged by excessive load exerted thereon. Therefore, the detachment of the cylinder at high speed is the required function of the rotary press, and if the printing operation is performed at higher speed, the cylinder has to be detached at higher speed. Thus, by detaching the cylinder at high speed, it becomes possible to prevent damage to the cylinder that is caused by the web 11 that is wrapped around the blanket cylinder by being cut.

When the pressure surface 38*c* is pushed against the pressure-receiving member 37, vertical force Pv and horizontal force Ph are applied to the shaft end portion 803 (903) of the printing cylinder 8 (9). A stopper 50 is arranged in close proximity to the shaft end portion 803 (903) (with a slight gap δ) in the direction where the horizontal force Ph is applied. This stopper 50 is firmly attached to the side frame 13*d*. In the case where there is no horizontal regulation when the pressure-receiving member 37 is pushed with the pressure member 39, the printing cylinder 8 (9) is shifted laterally with the bearing 86 (96) as center, as shown by a two-dot chain line in FIG. 21. However, since the pushing force has the horizontal component Ph and the stopper 50 is arranged in the direction of the horizontal component Ph, the horizontal movement of the shaft end portion 803 (903) can be stopped by the stopper 50. Thus, the printing cylinders 8, 9 can be stopped with slight axis offset.

Thus, according to this embodiment, the reaction that is applied to the drive-side bearings 86, 96 when interchanging the sleeves 801, 901 can be reduced. Therefore, in addition to the same advantages as the first embodiment, the associated members can be maintained with a high degree of accuracy and the service life can be prolonged. The constituent parts can be made smaller, so the costs and space for them can be saved.

Also, because the pressure device 39 for applying the pushing force R2 to the shaft 802 (902) of the printing cylinder 8 (9) is supported by the intermediate frame 36 firmly attached to the side frame 13*d* whose rigidity is high, pressure rigidity can be increased and, when pressure is applied, accuracy of alignment can be enhanced. Since the pressure member 38 surface-contacts with the pressure-receiving member 37, the pressure position becomes stable and the service life of the members can be prolonged. As the pressure device 39 is arranged outside the side frame 13*d*, there is no possibility that it will be stained with ink, etc., and it can maintain good accuracy. Thanks to these advantages, the positions of the bearings 84, 94 can be stabilized when interchanging sleeves 801, 901. Therefore, the operation of restoring the movable frame 25 can be smoothly performed and operation efficiency can be enhanced.

The pressure surface 38*c* of the pressure member 38 inclines slightly and pushes the printing cylinder 8 (9) in the lateral direction when pushing it, and the stopper 50 is arranged slightly away from the printing cylinder 8 (9) in the lateral direction where the printing cylinder 8 (9) is pushed. Therefore, even if the printing cylinder 8 (9) is shifted laterally, it is stopped at a position slightly away from the cylinder. That is, the lateral position can also be accurately determined, and when removing the sleeves 801, 901 from the detaching hole 131, the removing operation can be performed with a stable gap.

(E) Other Embodiments

While the present invention has been described with reference to the preferred embodiments thereof, the invention is not to be limited to the details given herein, but may be modified within the scope of the invention hereinafter claimed. For example, although the movable frame is moved in the lateral direction (horizontal direction), the moving direction is not limited if the movable frame slides along the side frame.

The structure for reducing the load applied to the bearing, described in the fourth embodiment, is not limited to the rotary press of the present invention. That is, the load-reducing structure is also applicable to all printing presses where a printing cylinder or its shaft is supported at one end by a bearing.

In the above-described embodiments, the position adjustment member 161 has arm-abutting surfaces 161A, 161C and connection surfaces 161B on both the top surface side and bottom surface side, respectively. However, either the top surface or the bottom surface may be made flat without forming the arm-abutting surfaces 161A, 161C and connection surface 161B. For example, when the top surface of the position adjustment member 161 is made flat, only the position of the lower blanket cylinder 9*b* can be finely adjusted, with the position of the upper blanket cylinder 9*a* fixed.

Instead of the applied-pressure adjusters 180*a*, 180*b*, the same device as the applied-pressure adjuster 160 may be arranged between the printing-cylinder supporting arm 81*a* of the plate cylinder 8*a* and the printing-cylinder supporting arm 81*b* of the plate cylinder 8*b* so that the positions of the plate cylinders 8*a*, 8*b* can be finely adjusted.

What is claimed is:

1. A rotary press comprising:

first and second side frames provided with a space, for supporting a printing cylinder;

a movable frame provided outside said first side frame;

a first supporting device, provided in said movable frame, for supporting one end portion of said printing cylinder;

a second supporting device, provided in said second side frame, for supporting the other end portion of said printing cylinder;

a first frame-moving device for moving said movable frame in an axial direction of said printing cylinder with respect to said first side frame so that said first supporting device is detachably fitted on said one end portion of said printing cylinder; and a second frame-moving device for sliding said movable frame with respect to said first side frame, with said first supporting device detached from said one end portion of said printing cylinder by axial movement of said movable frame.

2. The rotary press as set forth in claim 1, wherein said first supporting device and said second supporting device are constructed so that positions where said printing cylinder is supported can be adjusted according to a diameter of said printing cylinder.

3. The rotary press as set forth in claim 2, wherein a plurality of printing cylinders are provided in a printing press unit, and the plurality of printing cylinders are respectively comprised of interchangeable other printing cylinders, said first supporting device and said second supporting device are provided for each of said plurality of interchangeable printing cylinders, and said plurality of first supporting devices are provided in said movable frame.

4. The rotary press as set forth in claim 3, wherein said printing cylinder comprises a shaft and a sleeve, and said printing cylinder is interchanged by detaching only said sleeve from said shaft.

5. The rotary press as set forth in claim 1, wherein one of said movable frame and first side frame is provided with a protruding portion, the other of said movable frame and first side frame is provided with a recessed portion, and when said first supporting device engages with said one end portion of said printing cylinder, said protruding portion is fitted in said recessed portion so that said movable frame is positioned with respect to said first side frame.

6. The rotary press as set forth in claim 1, wherein a shaft of said printing cylinder extends beyond a supporting position where said printing cylinder is supported by said second supporting device, and said shaft has a pressure-receiving portion on a shaft end portion arranged outside said supporting position, and which further comprises a pressure device for pushing said pressure-receiving portion downwardly, and a moving device for moving said pressure device between an operating position and a retracted position.

7. The rotary press as set forth in claim 6, further comprising adjustment means for finely adjusting a position where said pressure-receiving portion is pushed by said pressure device, at said operating position.

8. The rotary press as set forth in claim 7, wherein said pressure device includes a pressure member with a flat pressure surface, and said pressure-receiving portion is rotatably provided on the shaft of said printing cylinder and has an outer peripheral portion constructed of a plurality of flat surfaces.

9. The rotary press as set forth in claim 8, wherein said pressure surface is formed so that a perpendicular line to said pressure surface inclines slightly within a plane perpendicular to the axis of said printing cylinder with respect to a direction where said pressure-receiving portion is pushed by said pressure member, and which further comprises a stopper provided near the other end portion of said printing cylinder and on a side where said perpendicular line inclines.

10. The rotary press as set forth in claim 6, wherein said pressure device is attached to the outside of said second side frame.

11. The rotary press as set forth claims 1, wherein said first supporting device serves as an arm having one end swingably supported by said movable frame and an intermediate portion that is engaged with one end portion of said printing cylinder, and which further comprises a position adjustment member having an arm-abutting surface that regulates a position of said arm by abutting said arm, constructed so that it is movable back and forth in a direction crossing a direction where said arm swings, and arranged to incline gently with respect to the moving direction so that said arm-abutting surface can continuously and variably adjust the position of said arm by the movement, said position adjustment member having a plurality of arm-abutting surfaces on a surface that faces said arm corresponding to a plurality of printing cylinders different in diameter, and also having a connection surface that smoothly connects said plurality of arm-abutting surfaces.

12. The rotary press as set forth in claim 11, further comprising an arm actuator provided on the other end of said arm for driving said arm in the swing direction, wherein a position where said printing cylinder is supported is adjusted to a predetermined position by performing the movement in the swing direction of said arm by the arm actuator, and by performing fine adjustment of a position of said arm by movement of said position adjustment member.

13. The rotary press as set forth in claim 11, wherein the fine adjustment of a position of said arm is determined by force applied to said arm-abutting surface by said arm actuator, and a position of said position adjustment member.

14. The rotary press as set forth in claim 11, wherein said arm has a roller follower that abuts the arm-abutting surface of said position adjustment member.

15. The rotary press as set forth in claim 11, wherein said printing cylinder comprises upper and lower printing cylinders provided to abut each other, said arm is respectively provided to each of said two printing cylinders, and said position adjustment member is provided between said two arms and has an upper arm-abutting surface and a lower arm-abutting surface corresponding to said two arms so that positions of said two arms can be simultaneously adjusted.

16. The rotary press as set forth in claim 15, wherein said two printing cylinders comprise blanket cylinders that transfer images to both sides of a web.

17. The rotary press as set forth in claim 16, further comprising:

a plate cylinder that abuts one of said blanket cylinders;

a plate-cylinder arm having one end swingably supported by said movable frame and an intermediate portion that is engaged with one end portion of said plate cylinder;

a plate-cylinder position adjustment member having a plate-cylinder arm-abutting surface that abuts said plate-cylinder arm to regulate a position of said plate-cylinder arm, and constructed so that it can move back and forth in the same direction as the swing direction of said plate-cylinder arm; and a plate-cylinder actuator provided on the other end of said plate-cylinder arm for driving said plate-cylinder arm in the swing direction;

wherein a position where said plate cylinder is supported is adjusted to a predetermined position by performing the movement in the swing direction of said plate-cylinder arm by the plate-cylinder actuator, and by performing fine adjustment of a position of said plate-cylinder arm by movement of said plate-cylinder position adjustment member.

18. The rotary press as set forth in claim 17, wherein said plate-cylinder arm has a roller follower that abuts the plate-cylinder arm-abutting surface of said plate-cylinder position adjustment member.

* * * * *